US011976421B2

(12) United States Patent
Sealey, II et al.

(10) Patent No.: US 11,976,421 B2
(45) **Date of Patent: *May 7, 2024**

(54) WET LAID DISPOSABLE ABSORBENT STRUCTURES WITH HIGH WET STRENGTH AND METHOD OF MAKING THE SAME

(71) Applicant: First Quality Tissue, LLC, Great Neck, NY (US)

(72) Inventors: James E. Sealey, II, Belton, SC (US); Kevin P. Brennan, Anderson, SC (US); Justin S. Pence, Anderson, SC (US)

(73) Assignee: First Quality Tissue, LLC, Great Neck, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/842,203

(22) Filed: Jun. 16, 2022

(65) Prior Publication Data

US 2023/0407575 A1 Dec. 21, 2023

(51) Int. Cl.

| | |
|---|---|
| ***D21H 11/18*** | (2006.01) |
| ***D21H 17/11*** | (2006.01) |
| ***D21H 17/37*** | (2006.01) |
| ***D21H 17/42*** | (2006.01) |
| ***D21H 17/55*** | (2006.01) |
| ***D21H 27/00*** | (2006.01) |
| ***D21H 27/40*** | (2006.01) |

(52) U.S. Cl.

CPC ..... *D21H 27/007* (2013.01); *D21H 11/18* (2013.01); *D21H 17/11* (2013.01); *D21H 17/375* (2013.01); *D21H 17/42* (2013.01); *D21H 17/55* (2013.01); *D21H 27/40* (2013.01)

(58) Field of Classification Search

CPC ..... D21H 27/007; D21H 11/18; D21H 17/11; D21H 17/375; D21H 17/42; D21H 17/55; D21H 27/40

USPC ..... 162/109

See application file for complete search history.

(56) References Cited

U.S. PATENT DOCUMENTS

| | | | |
|---|---|---|---|
| 2,926,154 | A | 2/1960 | Keim |
| 3,049,469 | A | 8/1962 | Davison |
| 3,058,873 | A | 10/1962 | Keim et al. |
| 3,066,066 | A | 11/1962 | Keim et al. |
| 3,125,552 | A | 3/1964 | Loshaek et al. |
| 3,186,900 | A | 6/1965 | De Young |
| 3,197,427 | A | 7/1965 | Schmalz |
| 3,224,986 | A | 12/1965 | Butler et al. |
| 3,224,990 | A | 12/1965 | Babcock |
| 3,227,615 | A | 1/1966 | Korden |
| 3,227,671 | A | 1/1966 | Keim |
| 3,239,491 | A | 3/1966 | Tsou et al. |
| 3,240,664 | A | 3/1966 | Earle, Jr. |
| 3,240,761 | A | 3/1966 | Keim et al. |
| 3,248,280 | A | 4/1966 | Hyland, Jr. |
| 3,250,664 | A | 5/1966 | Conte et al. |
| 3,311,594 | A | 3/1967 | Earle, Jr. |
| 3,329,657 | A | 7/1967 | Strazdins et al. |
| 3,332,834 | A | 7/1967 | Reynolds, Jr. |
| 3,332,901 | A | 7/1967 | Keim |
| 3,352,833 | A | 11/1967 | Earle, Jr. |
| 3,414,459 | A | 12/1968 | Wells |
| 3,442,754 | A | 5/1969 | Espy |
| 3,459,697 | A | 8/1969 | Goldberg et al. |
| 3,483,077 | A | 12/1969 | Aldrich |
| 3,556,907 | A | 1/1971 | Nystrand |
| 3,609,126 | A | 9/1971 | Asao et al. |
| 3,733,290 | A | 5/1973 | Williams et al. |
| 3,778,339 | A | 12/1973 | Lyman et al. |
| 3,813,362 | A | 5/1974 | Coscia et al. |
| 3,855,158 | A | 12/1974 | Petrovich et al. |
| 3,877,510 | A | 4/1975 | Tegtmeier et al. |
| 3,911,173 | A | 10/1975 | Sprague, Jr. |
| 3,994,771 | A | 11/1976 | Morgan, Jr. et al. |
| 3,998,690 | A | 12/1976 | Lyness et al. |
| 4,098,632 | A | 7/1978 | Sprague, Jr. |
| 4,102,737 | A | 7/1978 | Morton |
| 4,129,528 | A | 12/1978 | Petrovich et al. |
| 4,147,586 | A | 4/1979 | Petrovich et al. |
| 4,191,609 | A | 3/1980 | Trokhan |
| 4,501,862 | A | 2/1985 | Keim |
| 4,515,657 | A | 5/1985 | Maslanka |
| 4,529,480 | A | 7/1985 | Trokhan |
| 4,537,657 | A | 8/1985 | Keim |
| 4,714,736 | A | 12/1987 | Juhl et al. |
| 4,770,920 | A | 9/1988 | Larsonneur |
| 4,885,202 | A | 12/1989 | Lloyd et al. |
| 4,891,249 | A | 1/1990 | McIntyre |
| 4,949,688 | A | 8/1990 | Bayless |
| 4,996,091 | A | 2/1991 | McIntyre |
| 5,017,642 | A | 5/1991 | Hasegawa et al. |
| 5,143,776 | A | 9/1992 | Givens |
| 5,171,795 | A | 12/1992 | Miller et al. |
| 5,239,047 | A | 8/1993 | Devore et al. |
| 5,470,742 | A | 11/1995 | Bull et al. |
| 5,510,002 | A | 4/1996 | Hermans et al. |
| 5,516,885 | A | 5/1996 | Gorzynski et al. |

(Continued)

FOREIGN PATENT DOCUMENTS

| | | | |
|---|---|---|---|
| EP | 0696334 | B1 | 3/1999 |
| WO | 2009061079 | A1 | 5/2009 |

OTHER PUBLICATIONS

International Search Report and Written Opinion issued in Application No. PCT/US2022/033821, dated Sep. 7, 2022.

(Continued)

*Primary Examiner* — Mark Halpern

(74) *Attorney, Agent, or Firm* — Amster, Rothstein & Ebenstein LLP

(57) ABSTRACT

A method of making an absorbent structure including mixing ultra-high molecular weight ("UHMW") glyoxalated polyvinylamide adducts ("GPVM") and/or high molecular weight ("HMW"), glyoxalated polyacrylamide and/or high cationic charge glyoxalated polyacrylamide ("GPAM") copolymers and high molecular weight ("HMW") anionic polyacrylamide ("APAM") with the furnish during stock preparation of a wet laid papermaking process.

8 Claims, 6 Drawing Sheets

(56) References Cited

U.S. PATENT DOCUMENTS

| | | | | |
|---|---|---|---|---|
| 5,607,551 | A | 3/1997 | Farrington, Jr. et al. | |
| 5,714,552 | A | 2/1998 | Bower | |
| 5,843,763 | A | 12/1998 | Bull et al. | |
| 5,871,616 | A | 2/1999 | Bull et al. | |
| 6,056,855 | A | 5/2000 | Amey | |
| 6,057,420 | A | 5/2000 | Amey | |
| 6,342,580 | B1 | 1/2002 | Laurent et al. | |
| 6,376,578 | B1 | 4/2002 | Gorzynski et al. | |
| 6,429,267 | B1 | 8/2002 | Riehle | |
| 6,554,961 | B1 | 4/2003 | Riehle et al. | |
| 6,821,391 | B2 | 11/2004 | Scherb et al. | |
| 6,908,983 | B2 | 6/2005 | Maslanka | |
| 7,081,512 | B2 | 7/2006 | Riehle | |
| 7,175,740 | B2 | 2/2007 | Riehle et al. | |
| 7,303,652 | B2 | 12/2007 | Riehle et al. | |
| 7,339,378 | B2 | 3/2008 | Han et al. | |
| 7,351,307 | B2 | 4/2008 | Scherb et al. | |
| 7,387,706 | B2 | 6/2008 | Herman et al. | |
| 7,442,278 | B2 | 10/2008 | Murray et al. | |
| 7,476,293 | B2 | 1/2009 | Herman et al. | |
| 7,494,563 | B2 | 2/2009 | Edwards et al. | |
| 7,510,631 | B2 | 3/2009 | Scherb et al. | |
| 7,582,187 | B2 | 9/2009 | Scherb et al. | |
| 7,686,923 | B2 | 3/2010 | Scherb et al. | |
| 7,691,230 | B2 | 4/2010 | Scherb et al. | |
| 7,744,726 | B2 | 6/2010 | Scherb et al. | |
| 7,811,418 | B2 | 10/2010 | Klerelid et al. | |
| 7,887,673 | B2 | 2/2011 | Andersson et al. | |
| 7,905,989 | B2 | 3/2011 | Scherb et al. | |
| 7,931,781 | B2 | 4/2011 | Scherb et al. | |
| 7,932,349 | B2 | 4/2011 | Riehle et al. | |
| 7,951,269 | B2 | 5/2011 | Herman et al. | |
| 8,075,739 | B2 | 12/2011 | Scherb et al. | |
| 8,080,130 | B2 * | 12/2011 | Harper | D21H 15/02 162/149 |
| 8,092,652 | B2 | 1/2012 | Scherb et al. | |
| 8,101,710 | B2 | 1/2012 | Riehle et al. | |
| 8,118,979 | B2 | 2/2012 | Herman et al. | |
| 8,196,314 | B2 | 6/2012 | Munch | |
| 8,382,956 | B2 | 2/2013 | Boechat et al. | |
| 8,402,673 | B2 | 3/2013 | Da Silva et al. | |
| 8,435,384 | B2 | 5/2013 | Da Silva et al. | |
| 8,440,055 | B2 | 5/2013 | Scherb et al. | |
| 8,544,184 | B2 | 10/2013 | Da Silva et al. | |
| 8,580,083 | B2 | 11/2013 | Boechat et al. | |
| 9,719,212 | B2 | 8/2017 | Crisp et al. | |
| 2003/0000667 | A1 | 1/2003 | Riehle et al. | |
| 2008/0156450 | A1 | 7/2008 | Klerelid et al. | |
| 2009/0194244 | A1 | 8/2009 | Harper et al. | |
| 2010/0065234 | A1 | 3/2010 | Klerelid et al. | |
| 2011/0180223 | A1 | 7/2011 | Klerelid et al. | |
| 2013/0081771 | A1 | 4/2013 | Luo et al. | |
| 2015/0238650 | A1 | 8/2015 | Lu et al. | |
| 2016/0047090 | A1 | 2/2016 | Crisp et al. | |
| 2016/0265163 | A1 | 9/2016 | Hagiopol et al. | |
| 2016/0298297 | A1 | 10/2016 | Borkar et al. | |
| 2017/0233949 | A1 | 8/2017 | Borkar et al. | |
| 2017/0260696 | A1 | 9/2017 | Chou et al. | |
| 2019/0316298 | A1 | 10/2019 | Miller et al. | |
| 2020/0131709 | A1 | 4/2020 | Mitchell et al. | |
| 2020/0347556 | A1 | 11/2020 | Sealey, II et al. | |
| 2022/0192438 | A1 * | 6/2022 | Sealey, II | D21H 27/02 |

OTHER PUBLICATIONS

International Search Report and Written Opinion issued to PCT/US2021/064104 dated May 16, 2022.

Huang et al. "The role of polyaminoamide-epichlorohydrin (PAE) on antibody longevity in bioactive paper" Colloids and Surfaces B: Biointerfaces, vol. 158 (Oct. 1, 2017): pp. 197-202; abstract, p. 198 col. 1 para 4, p. 201 col. 2 para 1, fig. 4.

Crisp, Mark T. and Riehle, Richard J, Regulatory and sustainability initiatives lead to improved polyaminopolyamide-epichlorohydrin (PAE) wet-strength resins and paper products, TAPPI Journal, vol. 17, No. 9, Sep. 2018.

International Search Report and Written Opinion issued in Application No. PCT/US2023/068500, dated Nov. 7, 2023.

* cited by examiner

| Commercial Sample | 1,3-DCP (µg/l) | 3-MCPD (µg/l) | 1,3-DCP (ppb) | 3-MCPD (ppb) | PAE % Weight % |
|---|---|---|---|---|---|
| A- TAD towel Walgreens Oct 2020 | <2 | 110 | <2 | 2750 | 0.201 |
| B- Conventional Towel Walmart September 2020 | <2 | 180 | <2 | 4500 | NT |
| C- TAD towel Target October 2020 | <2 | 130 | <2 | 3250 | NT |
| D- TAD towel Walmart October 2020 | <2 | 86 | <2 | 2150 | 0.138 |
| E- TAD towel Costco September 2020 | <2 | 110 | <2 | 2750 | 0.176 |
| F-TAD towel Sam's September 2020 | <2 | 80 | <2 | 2000 | NT |
| G- TAD Towel Meijer October 2020 | <2 | 64 | <2 | 1600 | NT |
| H- TAD towel Winco August 2020 | <2 | 75 | <2 | 1875 | NT |
| I- TAD towel Simply Done September 2020 | <2 | 120 | <2 | 3000 | NT |
| K- TAD towel Sam's September 2020 | <2 | 100 | <2 | 2500 | NT |

NT = not tested

Table 1: Commercial retail towels samples

FIG. 9

WET LAID DISPOSABLE ABSORBENT STRUCTURES WITH HIGH WET STRENGTH AND METHOD OF MAKING THE SAME

FIELD OF THE INVENTION

The present invention relates to a method of producing wet laid disposable absorbent structures with high wet strength, made without polyaminoamide-epihalohydrin (PAE) or polyamine-epichlorohydrin resins and to wet laid disposable absorbent structures with very low doses of PAE resins.

BACKGROUND

Disposable paper towels, napkins, and facial tissue are absorbent structures that need to remain strong when wet. For example, paper towels need to retain their strength when absorbing liquid spills, cleaning windows and mirrors, scrubbing countertops and floors, scrubbing and drying dishes, washing/cleaning bathroom sinks and toilets, and even drying/cleaning hands and faces. A disposable towel that can perform these demanding tasks, while also being soft, has a competitive advantage as the towel could be multi-purpose and be used as a napkin and facial tissue. The same can be said about a napkin or facial tissue, where they could become a multi-purpose product if the right combination of quality attributes can be obtained of which strength when wet, absorbency, and softness are key attributes.

The industrial methods or technologies used to produce these absorbent structures are numerous. The technologies that use water to form the cellulosic (or other natural or synthetic fiber type) webs that comprise the towel or wipe are called Water-Laid Technologies. These include Through Air Drying (TAD), Uncreped Through Air Drying (UC-TAD), Conventional Wet Crepe (CWC), Conventional Dry Crepe (CDC), ATMOS, NTT, QRT and ETAD. Technologies that use air to form the webs that comprise the towel or wipe are called Air-Laid Technologies. To enhance the strength and absorbency of these towels and wipes, more than one layer of web (or ply) can be laminated together using strictly a mechanical process or preferably a mechanical process that utilizes an adhesive.

Absorbent structures can be produced using both Water or Air-Laid technologies. The Water-Laid technologies of Conventional Dry and Wet Crepe are the predominant method to make these structures. These methods comprise forming a nascent web in a forming structure, transferring the web to a dewatering felt where it is pressed to remove moisture, and adhering the web to a Yankee Dryer. The web is then dried and creped from the Yankee Dryer and reeled. When creped at a solids content of less than 90%, the process is referred to as Conventional Wet Crepe. When creped at a solids content of greater than 90%, the process is referred to as Conventional Dry Crepe. These processes can be further understood by reviewing Yankee Dryer and Drying, A TAPPI PRESS Anthology, pg 215-219, the contents of which are incorporated herein by reference in their entirety. These methods are well understood and easy to operate at high speeds and production rates. Energy consumption per metric ton is low since nearly half of the water removed from the web is through drainage and mechanical pressing. Unfortunately, the sheet pressing also compacts the web which lowers web thickness and resulting absorbency.

Through Air Drying (TAD) and Uncreped Through Air Drying (UCTAD) processes are Wet-Laid technologies that avoid compaction of the web during drying and thereby produce absorbent structures of superior thickness and absorbency when compared to structures of similar basis weight and material inputs that are produced using the CWC or CDC process. Patents which describe creped through air dried products include U.S. Pat. Nos. 3,994,771, 4,102,737, 4,191,609, 4,529,480, and 5,510,002, while U.S. Pat. No. 5,607,551 describes an uncreped through air dried product. The contents of these patents are incorporated herein by reference in their entirety.

The remaining Wet-Laid processes termed ATMOS, ETAD, NTT, STT and QRT can also be utilized to produce absorbent structures. Each process/method utilizes some pressing to dewater the web, or a portion of the web, resulting in absorbent structures with absorbent capacities that correlate to the amount of pressing utilized when all other variables are the same. The ATMOS process and products are documented in U.S. Pat. Nos. 7,744,726, 6,821,391, 7,387,706, 7,351,307, 7,951,269, 8,118,979, 8,440,055, 7,951,269 or 8,118,979, 8,440,055, 8,196,314, 8,402,673, 8,435,384, 8,544,184, 8,382,956, 8,580,083, 7,476,293, 7,510,631, 7,686,923, 7,931,781, 8,075,739, 8,092,652, 7,905,989, 7,582,187, and 7,691,230, the contents of which are incorporated herein by reference in their entirety. The ETAD process and products are disclosed in U.S. Pat. Nos. 7,339,378, 7,442,278, and 7,494,563, the contents of which are incorporated herein by reference in their entirety. The NTT process and products are disclosed in international patent application WO 2009/061079 A1 and U.S. Patent Application Publication Nos. US 2011/0180223 A1 and US 2010/0065234 A1, the contents of which are incorporated herein by reference in their entirety. The QRT process is disclosed in U.S. Patent Application Publication No. 2008/0156450 A1 and U.S. Pat. No. 7,811,418, the contents of which are incorporated herein by reference in their entirety. The STT process is disclosed in U.S. Pat. No. 7,887,673, the contents of which are incorporated herein by reference in their entirety.

All of the aforementioned Wet Laid Technologies may produce a single or multi-layered web of the absorbent structure. In order to create a multi-layered web, a double or triple layered headbox is utilized where each layer of the headbox can accept a different furnish stream.

To impart wet strength to the absorbent structure in the wet laid process, typically a cationic strength component, such as, for example, Kymene 5377, is added to the furnish during stock preparation. The cationic strength component can include any polyethyleneimine, polyethylenimine, polyaminoamide-epihalohydrin (preferably epichlorohydrin), polyamine-epichlorohydrin, polyamide, polyvinylamine, or polyvinylamide wet strength resin. Useful cationic thermosetting polyaminoamide-epihalohydrin ("PAE") and polyamine-epichlorohydrin resins are disclosed in U.S. Pat. Nos. 5,239,047, 2,926,154, 3,049,469, 3,058,873, 3,066,066, 3,125,552, 3,186,900, 3,197,427, 3,224,986, 3,224,990, 3,227,615, 3,240,664, 3,813,362, 3,778,339, 3,733,290, 3,227,671, 3,239,491, 3,240,761, 3,248,280, 3,250,664, 3,311,594, 3,329,657, 3,332,834, 3,332,901, 3,352,833, 3,248,280, 3,442,754, 3,459,697, 3,483,077, 3,609,126, 4,714,736, 3,058,873, 2,926,154, 3,877,510, 4,515,657, 4,537,657, 4,501,862, 4,147,586, 4,129,528, 3,855,158, 5,017,642, 6,908,983, 5,171,795, and 5,714,552, the contents of which are incorporated herein by reference in their entirety. Cationic thermosetting PAE resins are the most widely used wet strength resins in wet laid absorbent structures such as paper towel, napkin and facial tissue due to the chemistries ability to generate a high amount of wet strength at an affordable dosage. Unfortunately, during the synthesis of these PAE resins, byproducts are produced that are undesirable. These byproducts are called adsorbable organic halogens ("AOXs") and include 1,3-dichloro-2-propanol ("DCP") and 3-monochloro-1,2 propanediol ("CPD"). Known techniques for reducing the level of byproducts in PAE resins are disclosed in U.S. Pat. Nos. 5,470,742, 5,843,763, 5,871,616, 6,056,855, 6,057,420, 6,342,580, 6,554,961, 7,303,652, 7,175,740, 7,081,512, 7,932,349, 8,101,710, 5,516,885, 6,376,578, 6,429,267, and 9,719,212, the contents of which are incorporated herein by reference in their entirety. See, also, Crisp, Mark T. and Riehle, Richard J, *Regulatory and sustainability initiatives lead to improved polyaminopolyamide-epichlorohydrin (PAE) wet-strength resins and paper products*, TAPPI Journal, Vol. 17, No. 9, September 2018.

Techniques have been developed to reduce AOX in PAE resins. Those skilled in the art are familiar with industry terms such as G1, first generation PAE's with high AOX, G2 and G2.5 resins that feature reduced AOX (such as Kymene™ 925NA wet-strength resin and Kymene™ 217LX wet-strength resin, available from Solenis 2475 Pinnacle Drive, Wilmington, DE 19803 USA Tel: +1-866-337-1533) and also G3 resins such as Kymene™ GHP20 wet-strength resin also available from Solenis. G2 technology is taught in, for example, U.S. Pat. Nos. 5,017,642, 6,908,983, 5,171,795, and 5,714,552, the contents of which are hereby incorporated by reference in their entirety. G2 resins typically have less than 1000 ppm DCP by weight, and G3 resins typically contain less than 10 ppm DCP by weight. Those skilled in the art have also noted that in attempt to reduce AOX, the efficiency and functionality of the resin is compromised. Higher application levels are needed to achieve the same tensile targets.

As discussed, to impart wet strength to the absorbent structure in a wet laid process, a cationic strength component may be added to the furnish during stock preparation. To impart capacity for the cationic strength resins it is well known in the art to add water soluble carboxyl containing polymers to the furnish in conjunction with the cationic resin. Suitable carboxyl containing polymers include carboxymethylcellulose ("CMC") as disclosed in U.S. Pat. Nos. 3,058,873, 3,049,469 and 3,998,690, the contents of which are incorporated herein by reference in their entirety.

Absorbent structures are also made using the Air-Laid process. This process spreads the cellulosic, or other natural or synthetic fibers, in an air stream that is directed onto a moving belt. These fibers collect together to form a web that can be thermally bonded or spray bonded with resin and cured. Compared to Wet-Laid, the web is thicker, softer, more absorbent and also stronger. It is known for having a textile-like surface and drape. Spun-Laid is a variation of the Air-Laid process, which produces the web in one continuous process where plastic fibers (polyester or polypropylene) are spun (melted, extruded, and blown) and then directly spread into a web in one continuous process. This technique has gained popularity as it can generate faster belt speeds and reduce costs.

To further enhance the strength of the absorbent structure, more than one layer of web (or ply) can be laminated together using strictly a mechanical process or preferably a mechanical process that utilizes an adhesive. It is generally understood that a multi-ply structure can have an absorbent capacity greater than the sum of the absorbent capacities of the individual single plies. It is thought this difference is due to the inter-ply storage space created by the addition of an extra ply. When producing multi-ply absorbent structures, it is critical that the plies are bonded together in a manner that will hold up when subjected to the forces encountered when the structure is used by the consumer. Scrubbing tasks such as cleaning countertops, dishes, and windows all impart forces upon the structure which can cause the structure to rupture and tear. When the bonding between plies fails, the plies move against each other imparting frictional forces at the ply interface. This frictional force at the ply interface can induce failure (rupture or tearing) of the structure thus reducing the overall effectiveness of the product to perform scrubbing and cleaning tasks.

There are many methods used to join or laminate multiple plies of an absorbent structure to produce a multi-ply absorbent structure. One method commonly used is embossing. Embossing is typically performed by one of three processes: tip to tip (or knob to knob), nested, or rubber to steel ("DEKO") embossing. Tip to tip embossing is illustrated by commonly assigned U.S. Pat. No. 3,414,459, while the nested embossing process is illustrated in U.S. Pat. No. 3,556,907, the contents of which are incorporated herein by reference in their entirety. Rubber to steel DEKO embossing comprises a steel roll with embossing tips opposed to a pressure roll, sometimes referred to as a backside impression roll, having an elastomeric roll cover wherein the two rolls are axially parallel and juxtaposed to form a nip where the embossing tips of the emboss roll mesh with the elastomeric roll cover of the opposing roll through which one sheet passes and a second un-embossed sheet is laminated to the embossed sheet using a marrying roll nipped to the steel embossing roll. In an exemplary rubber to steel embossing process, an adhesive applicator roll may be aligned in an axially parallel arrangement with the patterned embossing roll, such that the adhesive applicator roll is upstream of the nip formed between the emboss and pressure roll. The adhesive applicator roll transfers adhesive to the embossed web on the embossing roll at the crests of the embossing knobs. The crests of the embossing knobs typically do not touch the perimeter of the opposing idler roll at the nip formed therebetween, necessitating the addition of a marrying roll to apply pressure for lamination.

Other attempts to laminate absorbent structure webs include bonding the plies at junction lines wherein the lines include individual pressure spot bonds. The spot bonds are formed by a thermoplastic low viscosity liquid such as melted wax, paraffin, or hot melt adhesive, as described in U.S. Pat. No. 4,770,920. Another method laminates webs of absorbent structure by thermally bonding the webs together using polypropylene melt blown fibers as described in U.S. Pat. No. 4,885,202. Other methods use meltblown adhesive applied to one face of an absorbent structure web in a spiral pattern, stripe pattern, or random pattern before pressing the web against the face of a second absorbent structure as described in U.S. Pat. Nos. 3,911,173, 4,098,632, 4,949,688, 4,891,249, 4,996,091 and 5,143,776, the contents of which are incorporated herein by reference in their entirety.

There is a continuing need for absorbent products with high wet strength, absorbency, and softness that are produced without any undesirable byproducts.

SUMMARY OF THE INVENTION

An object of the present invention is to provide a method of producing single or multi-ply, cellulosic based, wet laid, disposable, absorbent structures of high wet strength, absorbency, and softness using no or very low doses of PAE wet strength resin that contain or generate AOX byproducts.

A retail roll towel product according to an exemplary embodiment of the presnret invention comprises: at least one ply of a cellulose sheet or web having a cross direction wet strength of 80 to 200 N/m and a caliper of 600 to 1500 microns, wherein the retail roll towel product has a basis weight range of 38 to 45 g/m$^2$ and contains non detect to 550 ppb chloropropanediol and 0 to 0.1% by weight polyaminoamide-epihalohydrin.

In an exemplary embodiment, the cross direction wet strength is 80 to 150 N/m, the caliper is 700 to 1300 microns, and the towel product has a basis weight of 38 to 50 g/m$^2$, wherein the retail roll towel product contains 50 to 550 ppb chloropropanediol and 0.01 to 0.04% by weight polyaminoamide-epihalohydrin.

A retail roll towel product according to an exemplary embodiment of the present invention comprises: a two ply wet laid product with cross direction wet strength of 80 to 200 N/m and basis weight range of 38-45 g/m$^2$, where in the retail roll towel contains 0 to 0.1% by weight polyaminoamide-epihalohydrin.

A retail roll towel product according to an exemplary embodiment of the present invention comprises: a two ply wet laid product with cross direction wet strength of 80 to 200 N/M and caliper is 700 to 1300 microns, where in the retail roll towel contains 0 to 0.1% by weight polyaminoamide-epihalohydrin.

A retail roll towel product according to an exemplary embodiment of the present invention comprises: a two-ply cellulose sheet or web having a cross direction wet strength of 80 to 200 N/m and a two-ply caliper of 600 to 1500 microns, where the retail roll towel product contains 0 to 550 ppb chloropropanediol and 0 to 0.09% by weight polyaminoamide-epihalohydrin.

A tissue or paper towel product according to an exemplary embodiment of the present invention comprises: 95 to 99 percent by weight cellulose fibers; and 0.25 to 1.5 percent by weight ultra-high molecular weight glyoxalated polyvinylamide adducts and high molecular weight anionic polyacrylamide complex.

A tissue or paper towel product according to an exemplary embodiment of the present invention comprises: 95 to 99 percent by weight cellulose fibers; 0.25 to 1.5 percent by weight ultra-high molecular weight glyoxalated polyvinylamide adducts and high molecular weight anionic polyacrylamide complex; and 0.03 to 0.5 percent by weight polyvinylamine.

A method of making an absorbent structure according to an exemplary embodiment of the present invention comprises: forming a stock mixture comprising cellulose fibers, high molecular weight anionic polyacrylamide, and ultra-high molecular weight glyoxalated polyvinylamide adducts; and at least partially drying the stock mixture to form a web using a wet laid process, wherein no polyaminoamide-epihalohydrin is added to the stock mixture.

In exemplary embodiments, the absorbent structure has a dichloropropanol concentration of less than 50 ppb and a chloropropanediol concentration of less than 300 ppb.

In exemplary embodiments, the stock mixture further comprises: an additive selected from the group consisting of lignin, laccase polymerized lignin, hemicellulose, polymerized hemicellulose, hemp hurd, pectin, hydroxyethyl cellulose, carboxymethyl cellulose, guar gum, soy protein, chitin, polyvinylamine, polyethylenimine, and combinations thereof.

An absorbent product according to an exemplary embodiment of the present invention comprises cellulose fibers, a dichloropropanol concentration of less than 50 ppb and a chloropropanediol concentration of less than 300 ppb, and a cross direction wet strength of 80 to 200 n/m, wherein the product is free from polyaminoamide-epihalohydrin as measured using an "Adipate test".

In exemplary embodiments, the absorbent product is through air dried facial tissue, napkin, or towel.

A tissue product according to an exemplary embodiment of the present invention comprises: a two-ply creped through air dried retail towel with a cross direction wet strength of 80 to 150 N/m, a dry caliper of 700 to 1200 microns, measured chloropropanediol from 50 to 400 parts per billion in paper that makes up the product and measured dichloropropanol from 30 to 200 parts per billion in the paper, wherein polyvinyl amine is added to a wet-end of a papermaking machine used to make the tissue product.

A tissue product according to an exemplary embodiment of the present invention comprises: a two-ply creped through air dried retail towel with a cross direction wet strength of 80 to 150 N/m; a dry caliper of 700 to 1200 microns; measured chloropropanediol from 50 to 300 parts per billion in paper that makes up the product; and measured dichloropropanol from 5 to 50 parts per billion in the paper, wherein no PAE resin is added to a wet-end of a papermaking machine used to make the tissue product.

DESCRIPTION OF THE DRAWINGS

Various exemplary embodiments of this invention will be described in detail, with reference to the following figures, wherein:

FIG. 9 provides a table of results of measured DCP, CDP and PAE of commercially available samples of paper towels.

DETAILED DESCRIPTION

Figure 1:
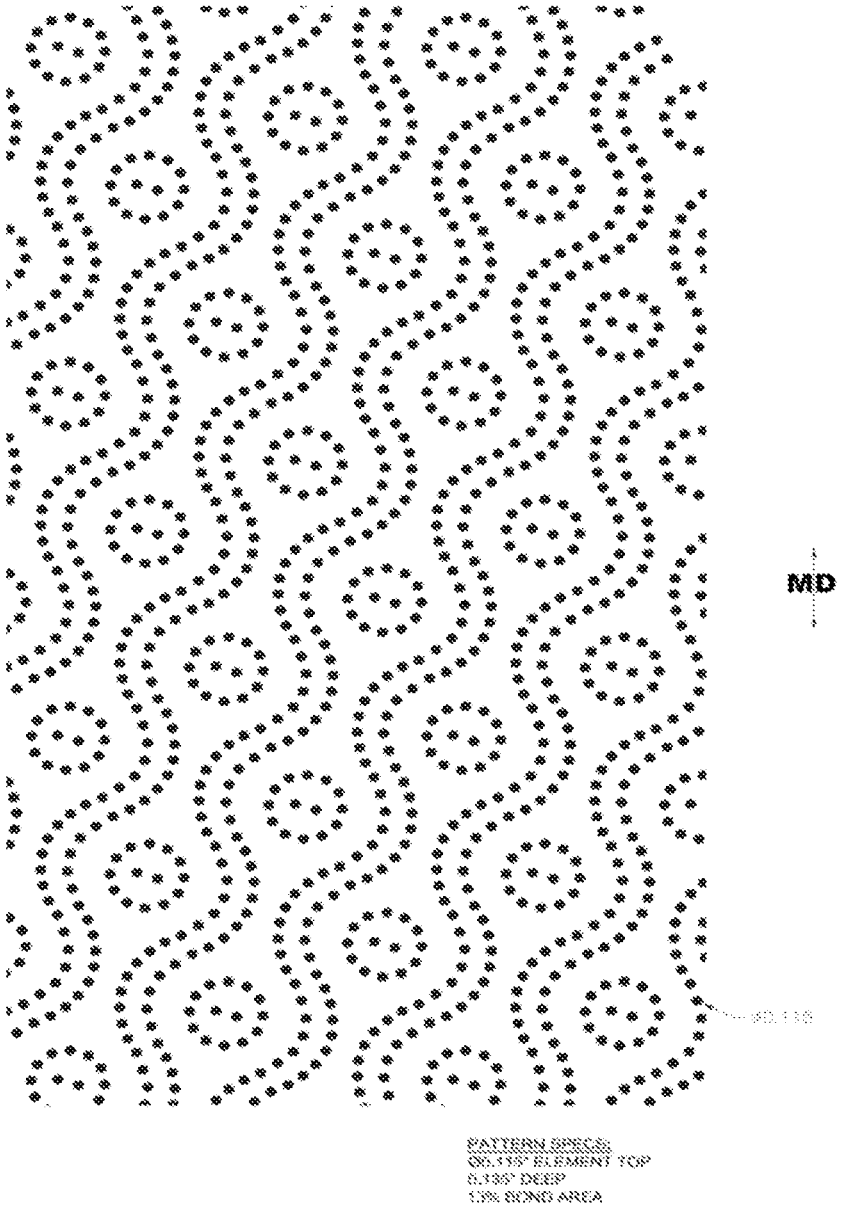
FIG. 1 shows a pattern formed on an absorbent structure in accordance with an exemplary embodiment of the present invention.

For the purposes of the description provided herein, the term "low doses of PAE resins" or "very low doses of PAE resins" refers to an absorbent structure that contains less than 2.5 kg of PAE per bone dry metric ton of the absorbent structure.

In exemplary embodiments, the absorbent product is made without PAE and therefore exhibits no presence of PAE (to the detectable limit of measurement methods) with analysis using an adipate and/or a glutarate specific method, and further, the product contains down to environmental background non-detect levels of DCP and CPD.

In accordance with exemplary embodiments, the method involves the use of ultra-high molecular weight ("UHMW") glyoxalated polyvinylamide adducts ("GPVM") and/or high molecular weight ("HMW"), glyoxalated polyacrylamide and/or high cationic charge glyoxalated polyacrylamide ("GPAM") copolymers and high molecular weight ("HMW") anionic polyacrylamide ("APAM") which are mixed with the furnish during stock preparation of a wet laid papermaking process. HMW APAM is defined as having a molecular weight greater than 500,000 Daltons and can be an inverse emulsion product or a solution product, with a solution product being preferred. Methods to produce UHMW GPVM are documented in U.S. Pat. No. 7,875,676 B2 and U.S. Pat. No. 9,879,381 B2, the contents of which are incorporated herein by reference in their entirety. These patents also characterize the polymer and the prepolymers including the molecular weight. Methods to produce high cationic charge HMW GPAM copolymers are documented in U.S. Pat. No. 9,644,320, the contents of which are incorporated herein by reference in their entirety. This patent also characterizes the polymers and the prepolymers including the molecular weight. In an exemplary embodiment involving the use of glyoxalated copolymer composition, the cationic copolymer before glyoxalation has a weight average molecular weight of about 120,000 to about 1 million Daltons, preferably about 120,000 to about 500,000 Daltons, more preferably about 150,000 to about 400,000 Daltons, even more preferably about 180,000 to about 250,000 Daltons, and most preferably about 200,000 to about 300,000 Daltons. Unless otherwise noted, all molecular weight is measured in units of Daltons and all "molecular weight" without further elaboration means a weight average molecular weight. The standard viscosity of the APAM copolymer (measured from 0.1 weight-% polymer solution in 1 M NaCl at 25° C. using a Brookfield viscometer with a UL adapter at 60 rpm) may be less than 1.5 or less than 1.6 or less than 1.7 or less than 1.8. The combination of these two or three or more chemistries (referred herein as wet strength agents) provides wet tensile strength of at least 15%, for example 20% or 25% or 30% or 40% or 50% or 60% of the value of the dry tensile strength of the absorbent product measured either in a cross direction or machine direction of the absorbent product. In embodiments, polyvinylamine (PVAM) chemistries can also greatly enhance the effectiveness of the wet strength system without adding PAE or chlorinated organics into the mixture.

In exemplary embodiments, the method may further include addition to the furnish of various combinations of biopolymers from wheat straw, oat, corn hull or the like including, but not limited to lignin, polymerized lignin, lignin polymerized with laccase, hemicellulose, polymerized hemicellulose, guar gum, cationic guar, CMC, chitin, chitosan, micro-fibrillated cellulose ("MFC"), thermo mechanical pulp, bleached chemi-thermo mechanical pulp, pectin, hemp hurd, and soy protein (or any protein source in which the MW of the protein is increased or chemically linked to the biopolymers listed above or pulp fibers). A method for making MFC is taught in U.S. Pat. No. 4,483,743, the contents of which are hereby incorporated by reference in their entirety. In exemplary embodiments, the method of the present invention may also involve the use of market pulp that has been coated with micro-fibrillated cellulose during or prior to the drying stage of the process of producing the market pulp sheets. The micro-fibrillated cellulose and other biopolymers provide a large amount of carboxyl and hydroxyl groups that can provide hydrogen bonding to both the cellulose fibers of the furnish and the wet strength agents to further improve the network of bonding to provide improved wet and dry strength. With improved dry strength, the refining of the cellulosic fibers can be minimized to improve product softness. Additionally, due to the high surface area of MFC, the absorbency of the final absorbent structure is improved. After mixing the wet strength agents with the furnish, which may contain the additives and market pulp coated with MFC, the remaining steps of the Wet Laid process are completed to produce the absorbent structure. One of the surprising aspects of the present invention is the use of conventional dry strength additives to enhance wet strength.

Coform material is conventionally used in paper products to impart strength and softness. The term "coform material" generally refers to composite materials comprising a mixture or stabilized matrix of thermoplastic fibers and a second non-thermoplastic material. As an example, coform materials may be made by a process in which at least one meltblown die head is arranged near a chute through which other materials are added to the web while it is forming. Such other materials may include, but are not limited to, fibrous organic materials such as woody or non-woody pulp such as cotton, rayon, recycled paper, pulp fluff and also superabsorbent particles or fibers, inorganic absorbent materials, treated polymeric staple fibers and the like. An example of coform material is taught in United States Patent Application Publication No. 20200276787. The present invention provides similar strength and softness to that provided by coform materials but without the use of plastics or extruded polymers. As used herein, "free from plastics or extruded polymers" means the paper product contains less than 1 wt % or less than 0.5 wt % or less than 0.1 wt % synthetic or plastic or extruded polymers.

In another exemplary embodiment, the above-mentioned methods can be enhanced or facilitated with the use of a high shear mixing device such as a medium consistency ("MC") pump (approximately 5-20% consistency) during the stock preparation step. Further examples of this include a fiber furnish homogenizer primarily used in low consistency stock mixing (about 0.1-5% consistency).

Figure 7:
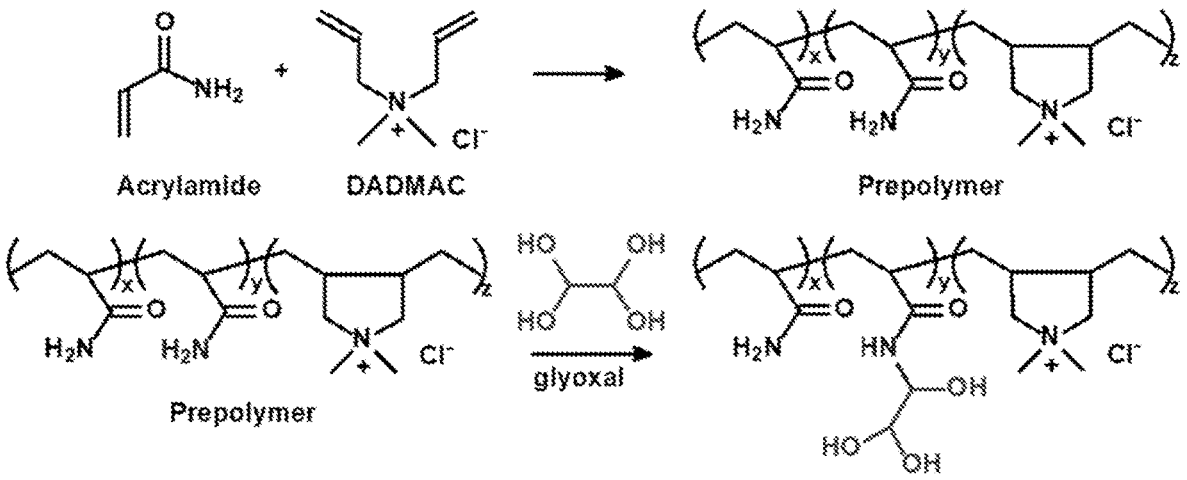
FIG. 7 shows chemical reactions resulting in a novel wet strength agent in accordance with exemplary embodiments of the present invention.

In another exemplary embodiment, rather than using UHMW GPVM, the method may include the synthesis and use of a novel wet strength agent by reacting vinylamide or CPAM polymers with glyoxal, oxidized lignin, and laccase. The reaction creates a cationic polymer that is similar to an ultra-high molecular weight glyoxylated polyvinlyamide adduct but is more rigid and branched through the incorporation of lignin into the polymer. Polymerization of the oxidized lignin is aided by the incorporation of the enzyme laccase during the synthesis process. Polyvinylpyrrolidone (PVP), polyvinylamine (PVAm), and/or anionic polyacrylamide (APAM) can be reacted with the above polymers to enhance the rigidity of the network. FIG. 7 shows chemical reactions resulting in the novel wet strength agent in accordance with exemplary embodiments of the present invention. Specifically, FIG. 7 shows reaction of acrylamide with diallyldimethylammonium chloride (DADMAC) resulting in a prepolymer that is then exposed to a crosslinking agent to produce the novel wet strength agent.

Figure 8:
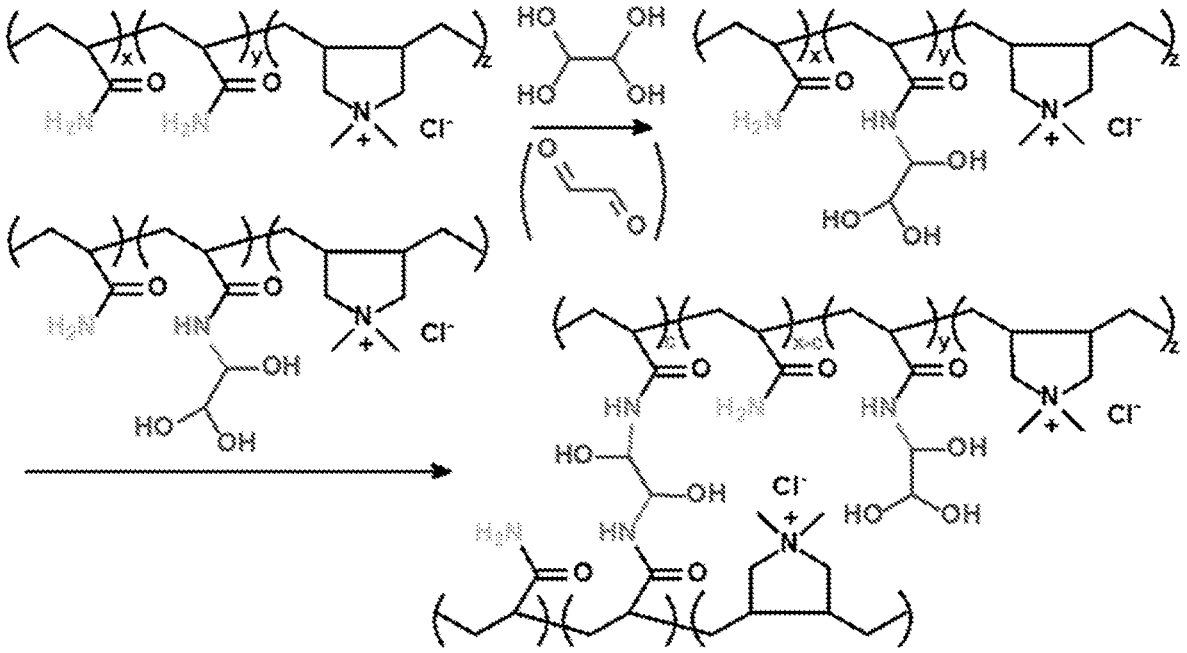
FIG. 8 shows chemical reactions resulting in a novel wet strength agent cross-linking with itself along with the formation of a large GPAM complex according to an exemplary embodiment of the present invention.

When this novel wet strength agent is mixed with cellulosic fibers in the wet end of a Wet Laid process, pendant aldehydes of the wet strength agent polymers (bonded through an amidol bond to the polyvinylamide backbone), react with the hydroxyl groups on cellulosic fibers to form hemiacetal bonds. Ionic bonds between the anionic charges on the cellulosic fiber and the cationic charges of wet strength agent polymers are also formed as are hydrogen bonds between the wet strength agent polymers and cellulosic fibers. The oxidized lignin incorporated into the wet strength agent polymers provides additional carboxyl groups to form hydrogen bonds to the hydroxyl groups on cellulosic fibers. Additionally, the pendant aldehyde groups of the wet strength agent polymers can react with the amide group of neighboring wet strength agent polymers in a crosslinking process to build a network of wet strength polymers that are also bonded to cellulosic fibers where the bonds have significant resilience to hydrolysis and thus provide wet strength. The branched structure of the wet strength agent polymers also provides improved accessibility to various cellulosic fibers. Higher molecular weight is also preferred as the size of the wet strength agent polymers are increased to further improve accessibility. Lastly, this novel polymer, which is highly branched with high molecular weight, increases the structural rigidity of the absorbent product to maintain the 3-dimentional structure, and thus absorbency, of the product when wet. FIG. 8 shows chemical reactions resulting in the novel wet strength agent cross-linking with itself along with the formation of a large GPAM complex according to an exemplary embodiment of the present invention.

In exemplary embodiments, a complex of the anionic polyacrylamide resin and an aldehyde-functionalized polymer resin possesses a net anionic charge (as tested by Mutek PCD03 test method). The amount of the GPAM/APAM complex on or in a towel or tissue product may range from about 0.25 to 1.5 percent, based on the total weight of the product.

In exemplary embodiments, modified GPAM may be used as a wet strength agent. Examples of modified GPAM include, but are not limited to, those with different molecular weight ranges or solids content or ratios of raw materials.

In exemplary embodiments, polyamine polymer wet strength additives may be suitable for use in the present invention. One suitable polyamine polymer is HERCOBOND 7530, which is available through Solenis. HERCOBOND 7530 is described in U.S. Pat. Nos. 9,885,155, 9,879,380, and 9,783,933, the contents of which are incorporated herein by reference in their entirety. Specifically, the chemistry associated with HERCOBOND 7530 may be described as Structure 1 which follows:

a functionalized vinylamine-containing base polymer comprises randomly distributed repeating monomer units having the formula (I), (II) and (III), (I)

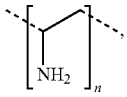

(II)

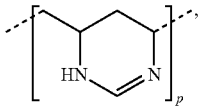

(III)

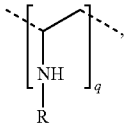

wherein R is a reacted α, β-unsaturated alkyl carbonyl compound through Michael addition by vinylamine in the polymer; n, p and q are the numbers indicating mole % of the repeating units of formula (I), (II) and (III) present in the functionalized vinylamine-containing polymer; and wherein n is from about 5 mole % to about 98 mole %, p is from about 1 mole % to about 80 mole %, q is from about 1 mole % to about 30 mole % the mole ratio of the functionalized vinylamine-containing base polymer to the vinyl monomer in the graft polymer is in the range of from about 10:90 to about 50:50.

The amount of polyamine polymer added to the paper may range from 0.1 to 10 kg/ton. The polyamine polymer may be added in combination with GPAM/APAM or in place of GPAM/APAM.

In exemplary embodiments, vinyl acetate and/or vinyl acetate esters may be suitable strength agents for use in the present invention. The amount of vinyl acetate and/or vinyl acetate ester added to the paper may range from 0.1 to 10 kg/ton. The vinyl acetate and/or vinyl acetate ester may be added in combination with GPAM/APAM or in place of GPAM/APAM.

In exemplary embodiments, cross-linked starches and/or reactive starches may be suitable strength agents for use in the present invention. The amount of cross-linked starch and/or reactive starch added to the paper may range from 0.1 to 10 kg/ton. The cross-linked starch and/or reactive starch may be added in combination with GPAM/APAM or in place of GPAM/APAM.

Reactive carbohydrates may be made through oxidation of the primary alcohol groups of carbohydrates (and carbohydrate derivatives) leading to the formation of aldehyde (R'—CHO) and/or carboxyl (R'—COOH) groups. The formation of aldehyde and carboxyl groups enhances the reactivity and versatility of the carbohydrate, and in particular enhances the reactivity of the carbohydrate to anionic polymers. A nitroxy radical mediator such as a di-tert-nitroxyl compound such as 2,2,6,6-tetramethylpiperidine-N-oxyl (TEMPO), an organic nitroxyl compound lacking a-hydrogen atoms such as 2,2,5,5-tetramethylpyrrolidine-N-oxyl (PROXYL), 4-hydroxy, 4-methoxy, 4-alkoxyl, 4-acetoxy, 4-phosphonooxy or 4-benzoyloxy-TEMPO, acylated derivatives thereof such as 4-acetamido- and 4-maleimido-TEMPO or dehydro-TEMPO (1,2,3,6-tetrahydro-2,2,6,6-tetramethylpyridin-1-oxyl) may be used to generate reactive carbohydrates. A molar ratio of nitroxy radical mediators to primary alcohol groups of 1:4 to 1:150, or from about 1:40 to 1:70 is typically used. The reactive carbohydrate may then be reacted with anionic materials like APAM, CMC and other cellulosic materials.

Absorbent products in accordance with exemplary embodiments of the present invention include at least one ply of paper. In an exemplary embodiment, absorbent products have two plies of paper. In another exemplary embodiment, absorbent products have three or more plies of paper. The absorbent product may have a caliper in the range of from about 600 to about 1500 microns, preferably 700 to 1300 microns, more preferably 725 to 1200 microns, and most preferably 735 to 1100 microns.

In exemplary embodiments, the CD wet strength of the absorbent product is in the range of from about 75 to about 200 n/m or 80 to 150 n/m or 85 to 145 n/m. In an exemplary embodiment, the CD wet strength is greater than 200 n/m or up to 500 n/m.

In exemplary embodiments, the wet caliper range of the absorbent product is from about 400 to about 800 microns or 450 to 650 microns or 470 to 575 microns.

In exemplary embodiments, the basis weight of the absorbent product is from about 35 to about 65 gsm or 38 to 52 gsm or 38 to 50 gsm or 38 to 45 gsm or 39 to 42 gsm.

In exemplary embodiments, the CD dry strength of the absorbent product is from about 275 to about 600 N/m or 325 to 525 N/m or 375 to 485 N/m or 380 to 450 N/m.

In exemplary embodiments, absorbency of the absorbent product determined in accordance with the GATS method is from about 11 to about 18 g/g or 12.5 to 16.0 g/g or 13.5 to 15.5 g/g. In accordance with a different absorbency test (dip and dunk test), products of the present invention may absorb from 500 to 700 grams of liquid.

As latex and hydrophobic materials may adversely affect absorbency, in embodiments of the invention, the paper is free from latex, synthetic fibers, bicomponent fibers and/or natural hydrophobic fibers. In a specific exemplary embodiment, the paper is free from latex. As used herein, free from latex or latex like polymers means that less than 0.5% by weight of material is removed from the paper when tested by extracting paper with acetone (following TAPPI paper extraction method T204 cm-07)

Absorbent products in accordance with exemplary embodiments of the present invention contain from about 95% to about 99% or from about 97% to about 99% by weight cellulosic fibers; from about 0.2% to about 1.5% or from about 0.05% to about 1.5% by weight high molecular weight anionic polyacrylamide; and from about 0.2% to about 0.8% or from about 0.05% to about 0.5% by weight ultra-high molecular weight glyoxalated polyvinylamide adducts and/or high cationic HMW GPAM copolymers. In an exemplary embodiment, the GPAM has a cationic charge density of 0.6 meq/g or less (as tested by Mutek PCD03 method). In exemplary embodiments, the absorbent products contain a biopolymer in place of or combined with the high molecular weight anionic polyacrylamide.

The absorbent products in accordance with exemplary embodiments of the present invention are substantially free of CPD, DCP and PAE. As used herein, the term "substantially free" is intended to mean that the paper contains: less than 550 parts per billion ("ppb") or from about 50 to about 550 ppb CPD; or less than about 200 ppb or from about 30 to about 200 ppb DCP, or from about 5 to 50 ppb DCP in the paper, and less than about 0.06% by weight PAE in the paper or no PAE resin added to the wet-end of the paper machine. The amount of PAE in the paper can be between 0.00 to 0.09% or between 0.00 to 0.03% or between 0.01 to 0.04% by weight. While the invention can be achieved by adding 2.5 kg/ton of PAE resin in the wet-end of the paper machine, the paper has the very low PAE or CPD/DCP described above while obtaining high wet strength, high bulk and absorbency.

In exemplary embodiments, the absorbent structure is a two-ply towel roll good sold as a retail towel. As used herein, "retail" means goods sold to the public/consumer in relatively small quantities for use or consumption rather than for resale.

The absorbent products in accordance with exemplary embodiments of the present invention have a wet cross direction tensile strength of 75 N/m to 200 N/m, preferably 80 to 150 N/m, and most preferably 85 to 145 N/m.

Absorbent structures prepared by the method in accordance with exemplary embodiments of the present invention include, but are not limited to, disposable paper towel, napkin, and facial products. Multiple plies of the absorbent structure can be plied together using any of the aforementioned lamination techniques to improve overall absorbency or softness.

Figure 6:
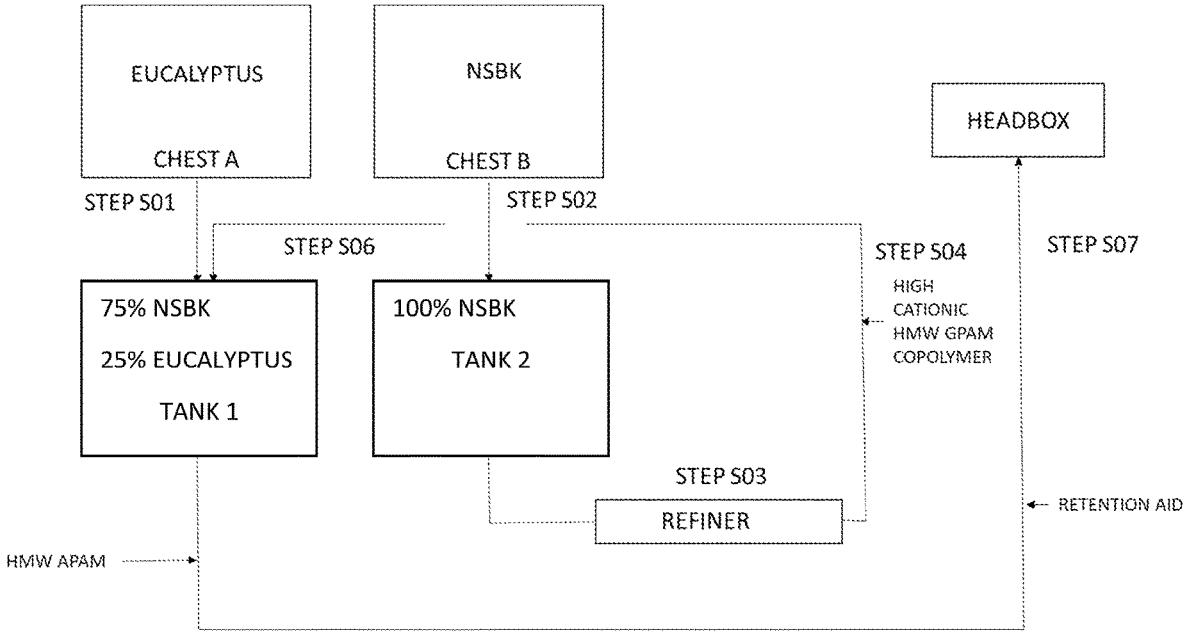
FIG. 6 is a flowchart showing a method of making an absorbent structure in accordance with an exemplary embodiment of the present invention.

FIG. 6 is a flow chart showing a method of making a paper towel product according to an exemplary embodiment of the present invention. As shown, the paper towel product is made on a wet-laid asset with a three-layer headbox using a through air dried method. The towel may be made from 75% northern bleached softwood kraft and 25% eucalyptus in all three layers. As shown in Step S01, the eucalyptus is delivered from Chest A to Blend Tank 1. In Step S02, the NSBK is delivered from Chest B to Blend Tank 2 and refined separately (Step S03) before blending into the layers. Also before blending into the layers, in Step S04, the NSBK is mixed with high cationic HMW GPAM copolymers (e.g., Hercobond™ Plus 555 dry-strength additive, purchased from Solenis 2475 Pinnacle Drive, Wilmington, DE 19803 USA Tel: +1-866-337-1533). At Step S06, the NSBK mixed with high cationic HMW GPAM copolymers is added to Blend Tank 2 to achieve a mixture of 75% NSBK and 25% eucalyptus. In Step S07, the mixture is delivered to the headbox while a HMW APAM (e.g., Hercobond™ 2800 dry-strength additive, purchased from Solenis) and a polyvinylamine retention aid (e.g., Hercobond™ 6950 dry-strength additive from Solenis) is added to the mixture.

In an exemplary embodiment, a foam process of forming paper is utilized. The process may include foam forming surfactants. A suitable foam process is taught in United States published patent application 20180140529, the contents of which are hereby incorporated by reference.

Test Methods

All testing is conducted on prepared samples that have been conditioned for a minimum of 2 hours in a conditioned room at a temperature of 23+/−1.0 deg Celsius, and 50.0%+/−2.0% Relative Humidity. The exception is softness testing which requires 24 hours of conditioning at 23+/−1.0 deg Celsius, and 50.0%+/−2.0% Relative Humidity.

Ball Burst Testing

The Ball Burst of a 2-ply tissue or towel web was determined using a Tissue Softness Analyzer (TSA), available from emtec Electronic GmbH of Leipzig, Germany using a ball burst head and holder. The instrument is calibrated every year by an outside vendor according to the instrument manual. The balance on the TSA was verified and/or calibrated before burst analysis. The balance was zeroed once the burst adapter and testing ball (16 mm diameter) were attached to the TSA. The testing distance from the testing ball to the sample was calibrated. A 112.8 mm diameter circular punch was used to cut out five round samples from the web. One of the samples was loaded into the TSA, with the embossed surface facing up, over the holder and held into place using the ring. The ball burst algorithm "Berst Resistance" was selected from the list of available softness testing algorithms displayed by the TSA. The ball burst head was then pushed by the TSA through the sample until the web ruptured and the force in Newtons required for the rupture to occur was calculated. The test process was repeated for the remaining samples and the results for all the samples were averaged and then converted to grams force.

For more detailed description for operating the TSA, measuring ball burst, and calibration instructions refer to the "Leaflet Collection" or "Operating Instructions" manuals provided by Emtec.

Wet Ball Burst Testing

The Wet Ball Burst of a 2-ply tissue or towel web was determined using a Tissue Softness Analyzer (TSA), available from Emtec Electronic GmbH of Leipzig, Germany using a ball burst head and holder. The instrument is calibrated every year by an outside vendor according to the instrument manual. The balance on the TSA was verified and/or calibrated before burst analysis. The balance was zeroed once the burst adapter and testing ball (16 mm diameter) were attached to the TSA. The testing distance from the testing ball to the sample was calibrated. A 112.8 mm diameter circular punch was used to cut out five round samples from the web. One of the samples was loaded into the TSA, with the embossed surface facing up, over the holder and held into place using the ring. The ball burst algorithm "Berst Resistance" was selected from the list of available softness testing algorithms displayed by the TSA. One milliliter of water was placed onto the center of the sample using a pipette and 30 seconds were allowed to pass before beginning the measurement. The ball burst head was then pushed by the TSA through the sample until the web ruptured and the force in Newtons required for the rupture to occur was calculated. The test process was repeated for the remaining samples and the results for all the samples were averaged and then converted to grams force.

For more detailed description for operating the TSA, measuring ball burst, and calibration instructions refer to the "Leaflet Collection" or "Operating Instructions" manuals provided by Emtec

Stretch & MD, CD, and Wet CD Tensile Strength Testing

A Thwing-Albert EJA series tensile tester, manufactured by Thwing Albert of West Berlin, NJ, an Instron 3343 tensile tester, manufactured by Instron of Norwood, MA, or other suitable vertical elongation tensile testers, which may be configured in various ways, typically using 1 inch or 3 inch wide strips of tissue or towel can be utilized to measure stretch and MD, CD and wet CD tensile strength. The instrument is calibrated every year by an outside vendor according to the instrument manual. Jaw separation speed and distance between jaws (clamps) is verified prior to use, and the balance "zero'ed". A pretension or slack correction of 5 N/m must be met before elongation begins to be measured. After calibration, 6 strips of 2-ply product, are cut using a 25.4 mm×120 mm die. When testing MD (Machine Direction) tensile strength, the strips were cut in the MD direction. When testing CD (Cross Machine Direction) tensile strength, the strips were cut in the CD direction. One of the sample strips was placed in between the upper jaw faces and clamped before carefully straightening (without straining the sample) and clamping the sample (hanging feely from the upper jaw) between the lower jaw faces with a gap or initial test span of 5.08 cm (2 inches). Using a jaw separation speed of 2 in/min, a test was run on the sample strip to obtain tensile strength and peak stretch (as defined by TAPPI T-581 om-17). The test procedure was repeated until all the samples were tested. The values obtained for the six sample strips were averaged to determine the tensile strength and peak stretch in the MD and CD direction. When testing CD wet tensile, the strips were placed in an oven at 105 degrees Celsius for 5 minutes and saturated with 75 microliters of deionized water at the center of the strip across the entire cross direction immediately prior to pulling the sample.

Basis Weight

Using a dye and press, six 76.2 mm by 76.2 mm square samples were cut from a 2-ply product being careful to avoid any web perforations. The samples were placed in an oven at 105 deg C. for a minimum of 3 minutes before being immediately weighed on an analytical balance to the fourth decimal point. The weight of the sample in grams was multiplied by 172.223 to determine the basis weight in grams/$m^2$. The samples were tested individually, and the results were averaged. The balance should be verified before use and calibrated every year by an outside vendor according to the instrument manual.

Caliper Testing

A Thwing-Albert ProGage 100 Thickness Tester Model 89-2012, manufactured by Thwing Albert of West Berlin, NJ was used for the caliper test. The instrument is verified before use and calibrated every year by an outside vendor according the instrument manual. The Thickness Tester was used with a 2 inch diameter pressure foot with a preset loading of 95 grams/square inch, a 0.030 inch/sec measuring speed, a dwell time of 3 seconds, and a dead weight of 298.45 g. Six 100 mm×100 mm square samples were cut from a 2-ply product with the emboss pattern facing up. The samples were then tested individually, and the results were averaged to obtain a caliper result in microns.

Wet Caliper

A Thwing-Albert ProGage 100 Thickness Tester Model 89-2012, manufactured by Thwing Albert of West Berlin, NJ was used for the caliper test. The instrument is verified before use and calibrated every year by an outside vendor according the instrument manual. The Thickness Tester was used with a 2 inch diameter pressure foot with a preset loading of 95 grams/square inch, a 0.030 inch/sec measuring speed, a dwell time of 3 seconds, and a dead weight of 298.45 g. Six 100 mm×100 mm square samples were cut from a 2-ply product with the emboss pattern facing up. Each sample was placed in a container that had been filled to a three inch level with deionized water. The container was large enough where the sample could be placed on top of the water without having to fold the sample. The sample sat in the water in the container for 30 seconds, before being removed and then tested for caliper using the ProGage. The samples were tested individually, and the results were averaged to obtain a wet caliper result in microns.

Softness Testing

Softness of a 2-ply tissue or towel web was determined using a Tissue Softness Analyzer (TSA), available from Emtec Electronic GmbH of Leipzig, Germany. The TSA comprises a rotor with vertical blades which rotate on the test piece to apply a defined contact pressure. Contact between the vertical blades and the test piece creates vibrations which are sensed by a vibration sensor. The sensor then transmits a signal to a PC for processing and display. The frequency analysis in the range of approximately 200 to 1000 Hz represents the surface smoothness or texture of the test piece and is referred to as the TS750 value. A further peak in the frequency range between 6 and 7 kHz represents the bulk softness of the test piece and is referred to as the TS7 value. Both TS7 and TS750 values are expressed as dB $V^2$ rms. The stiffness of the sample is also calculated as the device measures deformation of the sample under a defined load. The stiffness value (D) is expressed as mm/N. The device also calculates a Hand Feel (HF) number with the value corresponding to a softness as perceived when someone touches a sample by hand (the higher the HF number, the higher the softness). The HF number is a combination of the TS750, TS7, and stiffness of the sample measured by the TSA and calculated using an algorithm which also requires the caliper and basis weight of the sample. Different algorithms can be selected for different facial, toilet, and towel paper products. Before testing, a calibration check should be performed using "TSA Leaflet Collection No. 9" available from emtec. If the calibration check demonstrates a calibration is necessary, "TSA Leaflet Collection No. 10" is followed.

A 112.8 mm diameter round punch was used to cut out five samples from the web. One of the samples was loaded into the TSA, clamped into place (outward facing or embossed ply facing upward), and the TPII algorithm was selected from the list of available softness testing algorithms displayed by the TSA when testing bath tissue and the Facial II algorithm was selected when testing towel. After inputting parameters for the sample (including caliper and basis weight), the TSA measurement program was run. The test process was repeated for the remaining samples and the results for all the samples were averaged and the average HF number recorded.

For more detailed description for operating the TSA, measuring softness, and calibrations refer to the "Leaflet Collection" or "Operating Instructions" manuals provided by Emtec.

Absorbency Testing

Gravimetric Absorbency Test Method

An M/K GATS (Gravimetric Absorption Testing System), manufactured by M/K Systems, Inc., of Peabody, MA, USA was used to test absorbency using MK Systems GATS Manual from Jun. 29, 2020. The instrument is calibrated annually by an outside vendor according to the manual. Absorbency is reported as grams of water absorbed per gram of absorbent product. The following steps were followed during the absorbency testing procedure:

Turn on the computer and the GATS machine. The main power switch for the GATS is located on the left side of the front of the machine and a red light will be illuminated when power is on. Ensure the balance is on. A balance should not be used to measure masses for a least 15 minutes from the time it is turned on. Open the computer program by clicking on the "MK GATS" icon and click "Connect" once the program has loaded. If there are connectivity issues, make sure that the ports for the GATS and balance are correct. These can be seen in Full Operational Mode. The upper reservoir of the GATS needs to be filled with Deionized water. The Velmex slide level for the wetting stage was set at 6.5 cm. If the slide is not at the proper level, movement of it can only be accomplished in Full Operational Mode. Click the "Direct Mode" check box located in the top left of the screen to take the system out of Direct Mode and put into Full Operational Mode. The level of the wetting stage is adjusted in the third window down on the left side of the software screen. To move the slide up or down 1 cm at a time, the button for "1 cm up" and "1 cm down" can be used. If a millimeter adjustment is needed, press and hold the shift key while toggling the "1 cm up" or "1 cm down" icons. This will move the wetting stage 1 mm at a time. Click the "Test Options" Icon and ensure the following set-points are inputted: "Dip Start" selected with 10.0 mm inputted under "Absorption", "Total Weight change (g)" selected with 0.1 inputted under "Start At", Rate (g) selected with 0.05 inputted per (sec) 5 under "End At" on the left hand side of the screen, "Number of Raises" 1 inputted and regular raises (mm) 10 inputted under "Desorption", Rate (g) selected with −0.03 inputted per 5 sec under "End At" on the right hand side of the screen. The water level in the primary reservoir needs to be filled to the operational level before any series of testing. This involves the reservoir and water contained in it to be set to 580 grams total mass. Click on the "Setup" icon in the box located in the top left of the screen. The reservoir will need to be lifted to allow the balance to tare or zero itself. The feed and draw tubes for the system are located on the side and extend into the reservoir. Prior to lifting the reservoir, ensure that the top hatch on the balance is open to keep from damaging the top of the balance or the elevated platform that the sample is weighed on. Open the side door of the balance to lift the reservoir. Once the balance reading is stable a message will appear to place the reservoir again. Ensure that the reservoir does not make contact with the walls of the balance. Close the side door of the balance. The reservoir will need to be filled to obtain the mass of 580 g. Once the reservoir is full, the system will be ready for testing. Obtain a minimum number of four 112.8 mm diameter circular samples. Three will be tested with one extra available. Enter the pertinent sample information in the "Enter Material I.D." section of the software. The software will automatically date and number the samples as completed with any user entered data in the center of the file name. Click the "Run Test" icon. The balance will automatically zero itself. Place the pre-cut sample on the elevated platform, making sure the sample is not in contact with the balance lid. Once the balance load is stabilized, click "Weigh". Move the sample to the aluminum test plate on the wetting stage, centered with the emboss facing down. Ensure the sample does not touch the sides and place the cover on the sample. Click "Wet the Sample". The wetting stage will drop the preset distance to initiate absorption (10 mm). The absorption will end when the rate of absorption is less than 0.05 grams/5 seconds. When absorption stops, the wetting stage will rise to conduct desorption. Data for desorption is not recorded for tested sample. Remove the saturated sample and dry the wetting stage prior to the next test. Once the test is complete, the system will automatically refill the reservoir. Record the data generated for this sample. The data that is traced for each sample is the dry weight of the sample (in grams), the normalized total absorption of the sample reflected in grams of water/gram of product, and the normalized absorption rate in grams of water per second. Repeat procedure for the three samples and report the average total absorbency.

Dip and Dunk Absorbency Test Method

For the Dip and Dunk Absorbency test method, the below procedures were followed:

Preparation

1. Perform pre-checks
2. Ensure all tools & materials are available
3. Balance must be turned or running for 30-minutes prior to using
4. Verify calibration of balance
5. Place dry/empty beaker or plastic cup on A&D Balance
6. Follow sampling plan to determine routine testing hours
7. Use clicker press with 100 mm×100 mm certified cutting die to cut 8-samples evenly spaced across the width of the test sheet making sure not to include perforations in the samples 8. Prepare container with DI or RO water (see "Pre-Checks")

Pre-Checks/Preparations

1. Calibration of balance must be verified daily
2. A&D Balance must be calibrated by outside vendor bi-annually+/−30 days
3. The DI or RO water must be changed out every shift Dry Weight 1. Press "RE-ZERO" to tare out the weight of the beaker or plastic cup
2. Place the first dry sample in/on the plastic cup and when readout has stabilized record sample reading (see image 2A/2B & 5)
3. Remove sample from balance and retain sample in order for wet testing NOTE: It is very important that samples be kept in order so that correlating dry and wet weights are reported for the same cut sample. Assigning the wrong wet or dry weight to different samples will adversely affect the test results.

Repeat Steps 1-3 until dry weights have been recorded for all 8-samples

Wet Weight

1. Clip 2 corners of the first sample to a holder (NOTE: Verify that the angle of the clips (see Image 3) to ensure just enough contact with the corner of the sample to hold it in the clip)
2. Lower holder until sample is completely under water in the tray (make sure sample is fully covered with water)
3. Using stop watch or second hand on clock to measure time limit as accurately as possible, start count for 1-minute
4. When testing multiple samples, make sure to allow a minimum of 20 seconds between each sample to ensure you have an ample amount of time to record data accurately. Repeat Step 1-Step 2 for each sample.
5. After the minute passes, carefully lift first holder to remove the first sample from the water and suspend over water container allowing sample to drip
6. Restart watch and start counting for 1-minute
7. Wait a minimum of 20 seconds and then remove the next sample. Continue until all samples are removed
8. Place the measuring cup on the balance and tare out the weight of the measuring cup
9. Re-Zero Balance
10. At end of minute, carefully place the measuring cup under the sample (WITHOUT ALLOWING THE CUP TO TOUCH THE WATER) and un-clip the sample from holder
11. Place the measuring cup on the scale and when read-out has stabilized record wet sample reading
12. Follow Steps 8-11 for remaining samples (you can leave previous wet samples in measuring cup; just re-zero balance after each tested sample reading as per Step 9).

Calculations for Absorbency

Absorbency or water retention capacity of a sample is calculated as follows:

$$\text{Water Capacity g/g}=(\text{Wet Weight}-\text{Dry Weight})/\text{Dry Weight}$$

$$\text{Water Capacity gsm}=(\text{Wet Weight}-\text{Dry Weight})/0.01$$

Wet Scrub

A wet scrubbing test was used to measure the durability of a wet towel. The test involved scrubbing a sample wet towel with an abrasion tester and recording the number of revolutions of the tester it takes to break the sample. Multiple samples of the same product were tested and an average durability for that product was determined. The measured durability was then compared with similar durability measurements for other wet towel samples.

An abrasion tester was used for the wet scrubbing test. The particular abrasion tester that was used was an M235 Martindale Abrasion and Pilling Tester ("M235 tester") from SDL Atlas Textile Testing Solutions. The M235 tester provides multiple abrading tables on which the samples are abrasion tested and specimen holders that abrade the towel samples to enable multiple towel samples to be simultaneously tested. A motion plate is positioned above the abrading tables and moves the specimen holders proximate the abrasion tables to make the abrasions.

Figure 5:
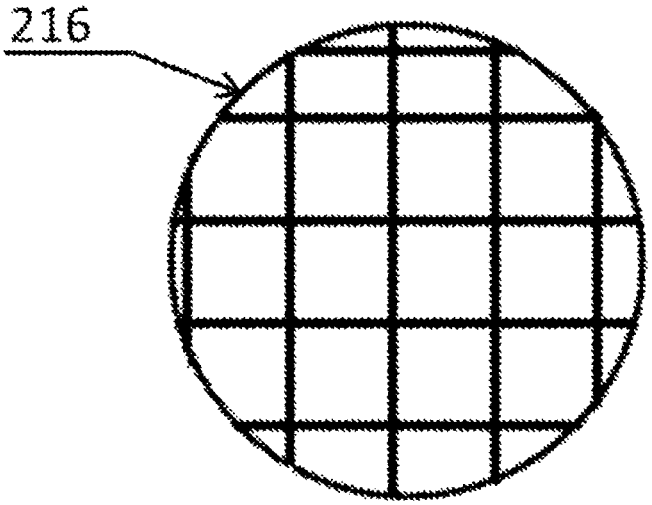
FIG. 5 is a top view of a textured polymer film used in a wet scrub test.

In preparation for the test, eight (8) towel samples, approximately 140 mm (about 5.51 inches) in diameter, were cut. Additionally, four (4) pieces, also approximately 140 mm (approximately 5.51 inches) in diameter, were cut from an approximately 82±1 μm thick non-textured polymer film. The non-textured side of a Ziploc® Vacuum Sealer bag from SC Johnson was used as the non-textured polymer film. However, any non-textured polymer film, such as high density polyethylene (HDPE), low density polyethylene (LDPE), polypropylene (PP), or polyester, to name a few, could be used. Additionally, four (4) 38 mm diameter circular pieces were cut from a textured polymer film with protruding passages on the surface to provide roughness. The textured polymer film that is used for this test is the textured side of a Ziploc® Vacuum Sealer bag from SC Johnson. The textured film has a square-shaped pattern (FIG. 5). The thickness of the protruding passages of the textured polymer film that are used are approximately 213±5 μm and the thickness of the film in the valley region of the textured film between the protruding passages are approximately 131±5 μm. The samples were cut using respective 140 mm diameter and 38 mm cutting dies and a clicker press.

Figure 3:
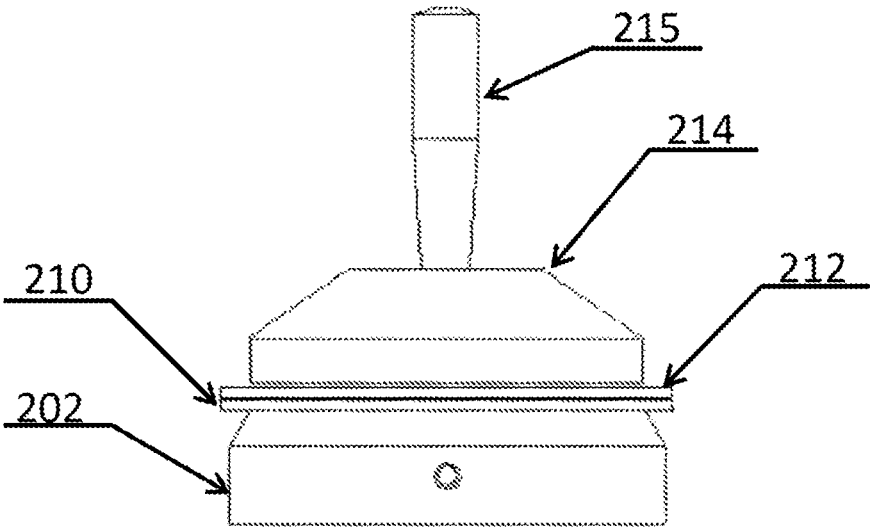
FIG. 3 show equipment used during a wet scrub test.
Figure 2:
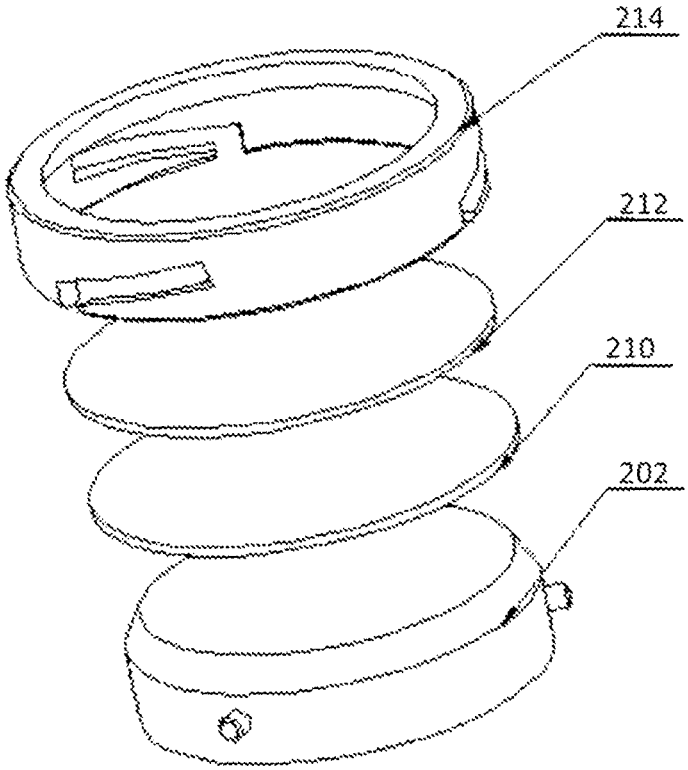
FIG. 2 is an exploded view of equipment used during a wet scrub test.

An example of an abrading table used in conjunction with the M235 tester is shown in FIG. 2. FIG. 2 presents an exploded view of the attachment of a towel sample to an abrading table 202. To insert each sample to be tested in an abrading table, the motion plate of an abrading table was removed from the tester, a clamp ring 214 was unscrewed, a piece of smooth polymer film 210 was placed on the abrading table 202, and a towel sample 212 was then placed on top of the smooth polymer film 210. A loading weight 215, shown in FIG. 3, was temporarily placed on top of the sample 212 on the abrading table 202 to hold everything in place while the clamp ring 214 was reattached to abrading table 202 to hold the towel sample 212 in place.

Figure 4:
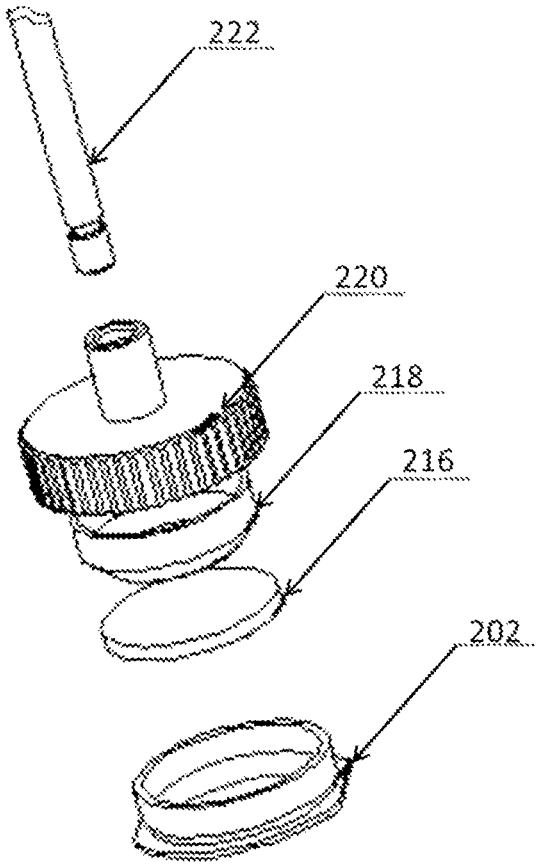
FIG. 4 is an exploded view of equipment used during a wet scrub test.

Referring to FIG. 4, for each abrading table 202 in the M235 tester, there is a corresponding specimen holder to perform the abrasion testing. The specimen holder was assembled by inserting a piece of the textured polymer film 216 within a specimen holder insert 218 that is placed beneath and held in place under a specimen holder body 220 with a specimen holder nut (not shown). A spindle 222 was mounted to the top center of the specimen holder body 220. A top view of the textured polymer film 216 of FIG. 4 is shown in FIG. 5.

The M235 tester was then turned on and set for a cycle time of 200 revolutions. 0.5 mL of water was placed on each towel sample. After a 30 second wait, the scrubbing test was initiated, thereby causing the specimen holder 206 to rotate 200 revolutions. The number of revolutions that it took to break each sample on the respective abrading table 202 (the "web scrubbing resistance" of the sample) was recorded. The results for the samples of each product were averaged and the products were then rated based on the averages.

Test Method for Detection of PAE in the Product

PAE can be measured by the method taught in "Determination of wet-strength resin in paper by pyrolysis-gas chromatography" (Paper Properties, February 1991 Tappi Journal, pages 197-201), which is hereby incorporated by reference in its entirety. PAE was determined indirectly through measuring cyclopentanone. A vertical microfurnace pyrolyzer (Yanagimoto GP-1018) was directly attached to a gas chromatograph (Shimadzu GC 9A) equipped with a flame ionization detector and a flame thermionic detector. About 0.5 mg of roll paper good or towel was pyrolyzed under the flow of nitrogen or helium carrier gas. The pyrolysis temperature was set empirically at 500° C. A fused-silica capillary column (50 m×0.25 mm id, Quadrex) coated with free fatty acid phase (FFAP, 0.25 um thick) immobilized through chemical crosslinking was used. The 50 ml/minute carrier gas flow rate at the pyrolyzer was reduced to 1 ml/minute at the capillary column by a splitter. The column temperature was initially set at 40° C. then programmed to 240° C. at a rate of 4° C. per minute. The pyrolysis chromatogram peaks were identified using a gas chromatograph-mass spectrometer (Shimadzu QP-1000) with an electron impact ionization source. Cyclopentanone standards were prepared and a calibration curve was generated, then roll paper good or towel samples were measured against the curve.

The product can be contaminated with PAE from the Yankee coating. To eliminate this issue, the test method above was repeated 10 times and the data with intermittently high levels of PAE was eliminated. Another method to determine if the PAE is due to surface Yankee coating contamination is to use the tape layer purity test to remove the Yankee layer from both plies of the two-ply towel, napkin or facial product. One must be careful to ensure the surface contacting of the Yankee surface is the surface removed by the tape. Some tissue product can be reverse laminated with the Yankee side placed in or the Yankee side to Yankee side laminated. After removing the Yankee layer, perform the test method above on the sample.

Alternatively, PAE testing may be performed by Intertek Polychemlab B.V., Koolwaterstofstraat 1, 6161 RA Geleen, the Netherlands.

A typical sample analysis included the following: 0.2 grams of sample material was added to 10 ml of 37% aqueous hydrochloric acid including pimelic acid (CAS 111-16-0) as an internal standard. This mixture was digested for 2 hours at 150° C. using a microwave. The resultant solution was transferred into 50 ml flasks and measured with liquid chromatography-mass spectroscopy, using adipic acid (CAS 124-04-9) and glutaric acid (CAS 110-94-1) as external standards. No internal standard correction was applied. All PAE values in this patent application are presented in weight % with adipic acid and glutaric acid values combined.

Test Method for Detection of DCP and CPD

DCP and CPD was measured by the ACOC Official Method 2000.01, which is hereby incorporated by reference in its entirety. A 1 mg/ml stock solution of CPD was prepared by weighing 25 mg CPD (98% isotopic purity, available through Sigma-Aldrich Company) into a 25 ml volumetric flask and diluting to volume with ethyl acetate. A 100 ug/ml intermediate standard solution of CPD was prepared by diluting 1 ml of the CPD stock solution with 9 ml of ethyl acetate. A 2 ug/ml CPD spiking solution was prepared by pipetting 2 ml of the CPD intermediate standard solution into a 100 ml volumetric flask and diluting to volume with ethyl acetate. A 1 mg/ml CPD-$d_5$ internal standard stock solution was prepared by weighing 25 mg CPD-$d_5$ into a 25 ml volumetric flask and diluting to volume with ethyl acetate. A 10 ug/ml CPD-$d_5$ internal standard working solution was prepared by diluting 1 ml CPD-$d_5$ internal standard stock solution in 100 ml ethyl acetate. CPD calibration solutions were prepared by pipetting the 100 ug/ml intermediate standard solution in aliquots of 0, 12.5, 25, 125, 250 and 500 ul into 25 ml volumetric flasks and diluting to volume with 2,2,4-trimethylpentane to obtain concentrations of 0.00. 0.05, 0.10, 0.50, 1.00 and 2.00 ug/ml CPD respectively.

A 5M sodium chloride solution was prepared by dissolving 290 g NaCl (Fisher) in 1 L water. A diethyl ether-hexane solution was prepared by mixing 100 ml diethyl ether with 900 ml hexane.

Prepared products were made by adding 10 g test portion roll bath tissue or towel (to the nearest 0.01 g) into a beaker. 100 ul internal standard working solution was added. 5M NaCl solution was added to a total weight of 40 g and blended to a homogenous mixture by crushing all small lumps using a spatula. The product was placed in an ultrasonic bath for 15 minutes. The bath was covered and the product was soaked for 12 to 15 hours. EXTRELUT™ refill pack (available through EM Science) was added to 20 g prepared product and mixed thoroughly with a spatula. The mixture was poured into a 40×2 cm id glass chromatography tube with sintered disc and tap. The tube was briefly agitated by hand to compact the contents, then topped with a 1 cm layer of sodium sulfate (Fisher) and left for 15 to 20 minutes. Nonpolar contents were eluted with 80 ml diethyl ether-hexane. Unrestricted flow was allowed except for powder soup, for which the flow was restricted to about 8 to 10 ml/min. The tap was closed when the solvent reached the sodium sulfate layer and the collected solvent was discarded. CPD was eluted with 250 ml diethyl ether at a flow rate of about 8 ml/min. 250 ml eluant was collected in a 250 ml volumetric flask. 15 g anhydrous sodium sulfate was added and the flask was left for 10 to 15 minutes.

The eluant was filtered through Whatman No. 4 filter paper into a 250 ml round bottom or pear shaped flask. The extract was concentrated to about 5 ml on a rotary evaporator at 35° C. The concentrated extract was transferred to a 10 ml volumetric flask with diethyl ether and diluted to volume with diethyl ether. A small quantity (approximately a spatula tip) anhydrous sodium sulfate was added to the flask and shaken, then left for 5 to 10 minutes. Using a 1 ml gas tight syringe, 1 ml extract was transferred to a 4 ml vial. The solution was evaporated to dryness below 30° C. under a stream of nitrogen. 1 ml 2,2,4-trimethylpentane and 0.05 ml heptafluorobutyrylimidazole were immediately added and the vial was sealed. The vial was shaken with a Vortex shaker for a few seconds and heated at 70° C. for 20 minutes in a block heater. The mixture was cooled to <40° C. and 1 ml distilled water was added. The mixture was shaken with a Vortex shaker for 30 seconds. The phases were allowed to separate, then shaking was repeated. The 2,2,4-trimethylpentane phase was removed to a 2 ml vial and a spatula tip of anhydrous sodium sulfate was added and shaken, then the vail was allowed to stand for 2 to 5 minutes. The solution was transferred to a new 2 ml vial for GC/MS. Parallel method blanks comprising 20 g 5M NaCl solution were run with each batch of tests.

Calibration samples were prepared by adding a set of 4 ml vials 0.1 ml of each of the calibration solutions, 10 ul CPD internal working standard and 0.9 ml 2,2,4-trimethylpentane and proceeding with the derivatization as above.

The calibration samples and product samples were analyzed on a gas chromatograph/mass spectrometer. The gas chromatograph was fitted with a split/splitless injector. The column was nonpolar, 30 m×0.25 mm, 0.25 mm film thickness (J&W Scientific) DB-5ms, or equivalent. The suggested temperature program was initial temperature 50° C. for 1 min, increase temperature at 2° C./min to 90° C.; increase temperature at maximum rate to 270° C.; hold for 10 min. The operating conditions were injector temperature, 270° C.; transfer line temperature, 270° C.; carrier gas, He at 1 mL/min; and injection volume, 1.5 mL in splitless mode with 40 s splitless period. The mass spectrometer was multiple-ion monitoring or full scanning at high sensitivity. The conditions were positive electron ionization with selected-ion monitoring of m/z 257 (internal standard), 453, 291, 289, 275, and 253 (CPD) or full scanning over the range 100 to 500 amu.

Areas of the 3-CPD-$d_5$ (m/z 257) and 3-CPD (m/z 253) derivative peaks were measured. The ratio of the area of the 3-CPD (m/z 253) derivative peak to the area of the 3-CPD-$d_5$ (m/z 257) derivative peak was calculated. A calibration graph was constructed for the standards by plotting the peak area ratio versus the weight in micrograms of the 3-CPD in each vial. The slope of the calibration line was calculated.

$$3\text{-}MCPD,\ \text{mg/kg} = \frac{(A \times 10)/(A' \times C)}{\text{Test portion, g}}$$

where MCPD=molecular CPD; A=peak area for the 3-CPD derivative; A'=peak area for the 3-CPD-$d_5$ derivative; and C=slope of the calibration line. The same sample and standard preparation and analysis techniques were used to analyze for DCP (which will have different retention time peak and molecular weight on the mass spectrometer). The limit of detection (or non-detect) for MCPD was <50 ppb and for CPD was <25 ppb.

If CPD or DCP was detected when no PAE was added to the wet end of the paper machine, it was determined if these chemicals were from the Yankee coating, by using the tape layer purity test to remove the Yankee layer from both plies of the two ply towel, napkin or facial product. One must be careful to ensure the surface contacting of the Yankee surface is the surface removed by the tape. Some tissue product can be reverse laminated with the Yankee side placed in or the Yankee side to Yankee side laminated. After removing the Yankee layer, the test method above was performed on the sample.

Commercially available samples of paper towels were measured for DCP, CDP and PAE. The results are shown in Table 1 in FIG. 9.

Test Method For Amount of GPAM/APAM Complex in Product

The following test method was used to determine the amount of GPAM/APAM complex in the final product:

1. Weigh sample and record (towel 3-4 sheets, tissue 6-7 sheets)
2. Place sample in Soxhlet Extraction Body.
3. Fill a 250 ml Flat-Bottom Boiling Flask (VWR Cat. No. 89000-330) approximately halfway with DI water.
4. Place the Soxhlet Extraction Body into the neck of the flat-bottom boiling flask.
5. Attach the assembled unit to the bottom of a hot water condenser, so the flat-bottom boiling flask is sitting on a hot plate.
6. Wrap the assembled unit in two insulating cloths.
7. Turn the hot plate on to 400° C.
8. Turn cold water to the condenser on until you see water running through the hoses attached to the condenser and water is coming out of the affluent tube in the sink. The flow should be steady, but not high.
9. Allow the extraction to run overnight.
10. The following day turn the hot plate off and remove the insulating cloths. Allow the assembled unit to cool down until able to touch.
11. Remove assembled unit from condenser. With the assembled unit still attached together, rinse the soxhlet exraction body with DI water from a DI water bottle. This is to ensure all of the water used during the extraction process flows to the flat-bottom flask.
12. Detach the soxhlet extraction body from the flat-bottom flask making sure any remnants from the extraction body are allowed to drain into the flat-bottom flask.
13. Weigh a 250 ml beaker and record its weight. Then bring to a hood.
14. Pour the contents of the flat-bottom flask into the beaker.
15. Place the beaker on the hot plate set at 150° C. to allow the water to evaporate out.
16. Once all the water is evaporated and the extract is the only thing left in the beaker, turn off the hot plate and let the beaker cool to room temperature.
17. Weigh the beaker+extract and record.
18. Subtract the beaker weight from the beaker+extract weight to determine the extract weight. Finally divide the extract weight by the original sample weight and multiply by 100 to get the % extract. (See chart below)

| Sample Wt | Beaker Wt | Beaker + Extract Wt | Extract Wt | Extract % |
|---|---|---|---|---|
| A | B | C | =C − B | =((C − B)/A)*100 |

Test Method for Charge Density Characterization of HMW APAM

Anionic polyacrylamide systems were characterized by both molecular weight and charge density. For charge density measurements, a Mutek PCD-05 particle charge detector was used. The anionic polyacrylamide samples were diluted to approximately 0.04% by weight in deionized water, then 2 mL of this solution was added to 8 mL of 0.01M phosphate buffer at pH 6 in the Mutek measuring cell. The samples were titrated with polydiallyldimethylammonium chloride ("polyDADMAC") until a streaming potential of 0 mV was measured. The reported values were based upon the dry weight of polymer.

Test Method For Molecular Weight Characterization of HMW APAM

Anionic polyacrylamide molecular weight properties and weight average molecular weight (Mw) were determined using size exclusion chromatography with the following conditions:

Mobile Phase: 0.1 M sodium nitrate/20% acetonitrile
Flow Rate: 0.8 ml/min
Columns: 2 TSKgel GMPWxl in series
Column Temperature: 40° C.
DRI Detector Temperature: 40° C.
Calibration: Relative to poly(acrylic acid) sodium salt, narrow molecular weight standards
Sample Concentration: Typically, 2 mg/ml in mobile phase
Sample prep: Stir in mobile phase 1-2 hours
Filtration: 0.45 μm PVDF syringe filter

* * *

EXAMPLES

For the following examples, UHMW GPAM copolymers (Hercobond™ Plus 555 dry-strength additive), was produced by Solenis according to the process as described in U.S. Pat. Nos. 7,875,676 B2 and 9,879,381 B2, which are hereby incorporated by reference in their entirety, and shipped to the manufacturing location at 2% solids to prevent chemical crosslinking. Production of the UHMW GPAM on site is preferred in order to reduce shipping costs and maintain maximum chemical efficiency.

Example 1

Paper towel was made on a wet-laid asset with a three layer headbox using the through air dried method. A TAD fabric design named AJ469 supplied by Asten Johnson (4399 Corporate Road, Charleston, SC 29405 USA Tel: +1.843.747.7800) was utilized. The flow to each layer of the headbox was about 33% of the total sheet. The three layers of the finished tissue from top to bottom were labeled as air, core and dry. The air layer is the outer layer that is placed on the TAD fabric, the dry layer is the outer layer that is closest to the surface of the Yankee dryer and the core is the center section of the tissue. The towel was produced with 75% NBSK (Peace River NBSK, purchased from Mercer, Suite 1120, 700 West Pender Street Vancouver, BC V6C 1G8 Canada) and 25% eucalyptus (Cenibra pulp purchased from Itochu International 1251 Avenue of the Americas, New York, NY 10020, Tel: +1-212-818-8244) in all three layers. High cationic HMW GPAM copolymers (Hercobond™ Plus 555 dry-strength additive, purchased from Solenis 2475 Pinnacle Drive, Wilmington, DE 19803 USA Tel: +1-866-337-1533) at 11.0 kg/metric ton (dry basis) and 3.75 kg/metric ton (dry basis) of a HMW APAM (Hercobond™ 2800 dry-strength additive, purchased from Solenis) were added to each of the three layers to generate wet strength. The NBSK was refined separately before blending into the layers using 70 kwh/metric ton on one conical refiner. The Yankee and TAD section speed was 1200 m/min running 5% slower than the forming section. The Reel section was additionally running 3% faster than the Yankee. The towel was then plied together using the DEKO method described herein using a steel emboss roll with the pattern shown in FIG. 1 and 7% polyvinyl alcohol based adhesive heated to 120 deg F. A rolled 2-ply product was produced with 156 sheets and a roll diameter of 148 mm, with each sheet having a length of 6.0 inches and a width of 11 inches. The 2-ply tissue product had the following product attributes: Basis Weight 43.3 g/m$^2$, Caliper 0.749 mm, MD tensile of 497 N/m, CD tensile of 480 N/m, a ball burst of 1105 grams force, an MD stretch of 18.5%, a CD stretch of 11.8%, a CD wet tensile of 117.2 N/m, an absorbency of 13.25 g/g, a dip and dunk absorbency of 556 gsm, and a TSA hand-feel softness of 46.2, with a TS7 of 24.7, and a TS750 of 36.4. No PAE resin was used in this example.

Comparative Example 1

Paper towel was made on a wet-laid asset with a three layer headbox using the through air dried method. A TAD fabric design named AJ469 supplied by Asten Johnson (4399 Corporate Road, Charleston, SC 29405 USA Tel: +1.843.747.7800) was utilized. The flow to each layer of the headbox was about 33% of the total sheet. The three layers of the finished tissue from top to bottom were labeled as air, core and dry. The air layer is the outer layer that is placed on the TAD fabric, the dry layer is the outer layer that is closest to the surface of the Yankee dryer and the core is the center section of the tissue. The towel was produced with 75% NBSK (Peace River NBSK, purchased from Mercer, Suite 1120, 700 West Pender Street Vancouver, BC V6C 1G8 Canada) and 25% eucalyptus (Cenibra pulp purchased from Itochu International 1251 Avenue of the Americas, New York, NY 10020, Tel : +1-212-818-8244) in all three layers. Polyamine polyamide-epichlorohydrin resin (Kymene™ 1500LV wet-strength resin, purchased from Solenis 2475 Pinnacle Drive, Wilmington, DE 19803 USA Tel: +1-866-337-1533) at 9.0 kg/metric ton (dry basis) and 3.75 kg/metric ton (dry basis) of a high molecular weight Anionic Polyacrylamide (Hercobond™ 2800 dry-strength additive, purchased from Solenis) were added to each of the three layers to generate wet strength. The NBSK was refined separately before blending into the layers using 70 kwh/metric ton on one conical refiner. The Yankee and TAD section speed was 1200 m/min running 5% slower than the forming section. The Reel section was additionally running 3% faster than the Yankee. The towel was then plied together using the DEKO method described herein using a steel emboss roll with the pattern shown in FIG. 1 and 7% polyvinyl alcohol based adhesive heated to 120 deg F. A rolled 2-ply product was produced with 143 sheets and a roll diameter of 148 mm, with each sheet having a length of 6.0 inches and a width of 11 inches. The 2-ply tissue product had the following product attributes: Basis Weight 40.0 g/m$^2$, Caliper 0.808 mm, MD tensile of 334 N/m, CD tensile of 343 N/m, a ball burst of 827 grams force, an MD stretch of 18.1%, a CD stretch of 11.1%, a CD wet tensile of 99.8 N/m, an absorbency of 15.8 g/g, a dip and dunk absorbency of 598 gsm, and a TSA hand-feel softness of 47.3, with a TS7 of 23.1, and a TS750 of 37.1. The measured concentration of CPD in the product was 900 parts per billion while the measured DCP concentration was less than 50 parts per billion. Test Method: Paragraph 64 of the LFGB, Method B 80.56-2-2002-09 by means of GCMS. The water extract was prepared according to DIN EN 645: 1994-01, 10 g of paper per 250 ml cold water. ISEGA (Zeppelinstraße 3, 63741 Aschaffenburg, Germany) was the vendor that conducted the testing. PAE content was 0.165%. Limited machine white water recycled and no furnish recycled or broke was used.

Example 2

Paper towel was made on a wet-laid asset with a three layer headbox using the through air dried method. A TAD fabric design named AJ469 supplied by Asten Johnson (4399 Corporate Road, Charleston, SC 29405 USA Tel: +1.843.747.7800) was utilized. The flow to each layer of the headbox was about 33% of the total sheet. The three layers of the finished tissue from top to bottom were labeled as air, core and dry. The air layer is the outer layer that is placed on the TAD fabric, the dry layer is the outer layer that is closest to the surface of the Yankee dryer and the core is the center section of the tissue. The towel was produced with 75% NBSK (Grand Prairie NBSK, purchased from International Paper, 6400 Poplar Ave, Memphis, TN 38197. Tel: 1-901-419-6500) and 25% eucalyptus (Cenibra pulp purchased from Itochu International 1251 Avenue of the Americas, New York, NY 10020, Tel: +1-212-818-8244) in all three layers. High cationic HMW GPAM copolymers (Hercobond™ Plus 555 dry-strength additive, purchased from Solenis 2475 Pinnacle Drive, Wilmington, DE 19803 USA Tel: +1-866-337-1533) at 9.0 kg/metric ton (dry basis) and 5.0 kg/metric ton (dry basis) of a HMW APAM (Hercobond™ 2800 dry-strength additive, purchased from Solenis) were added to each of the three layers to generate wet strength. Additionally, 1.5 kg/metric ton (dry basis) of a polyvinylamine retention aid (Hercobond™ 6950 dry-strength additive from Solenis) was utilized. The NBSK was refined separately before blending into the layers using 60 kwh/metric ton on one conical refiner. The Yankee and TAD section speed was 1200 m/min running 6% slower than the forming section. The Reel section was additionally running 3% faster than the Yankee. The towel was then plied together using the DEKO method described herein using a steel emboss roll with the pattern shown in FIG. 1 and 7% polyvinyl alcohol based adhesive heated to 120 deg F. A rolled 2-ply product was produced with 164 sheets and a roll diameter of 148 mm, with each sheet having a length of 6.0 inches and a width of 11 inches. The 2-ply tissue product had the following product attributes: Basis Weight 40.7 g/m$^2$, Caliper 0.726 mm, MD tensile of 476 N/m, CD tensile of 421 N/m, a ball burst of 1055 grams force, an MD stretch of 19.5%, a CD stretch of 11.4%, a CD wet tensile of 120.9 N/m, an absorbency of 12.58 g/g, a dip and dunk absorbency of 535 gsm, and a TSA hand-feel softness of 44.6, with a TS7 of 24.3, and a TS750 of 47.3, a wet scrub of 103 revolutions, a wet caliper of 504 microns/2ply, and a wet ball burst of 342 gf. The measured concentration of CPD in the product was less than 50 parts per billion while the measured DCP concentration was less than 50 parts per billion, Test Method: Paragraph 64 of the LFGB, Method B 80.56-2-2002-09 by means of GCMS. The water extract was prepared by according to DIN EN 645: 1994-01, 10 g of paper per 250 ml cold water. ISEGA (Zeppelinstraße 3, 63741 Aschaffenburg, Germany) was the vendor that conducted the testing. No machine white water or furnish were reused or recycled. PAE content was 0.02%. No adipic acid PAE was found in this sample, and only a small amount of glutaric acid PAE was detected, which is known to be added to the Yankee coating. Limited machine white water recycled and no furnish recycled or broke was used.

Example 3

Paper towel was made on a wet-laid asset with a three-layer headbox using the through air dried method. A TAD fabric design named AJ469 supplied by Asten Johnson (4399 Corporate Road, Charleston, SC 29405 USA Tel: +1.843.747.7800) was utilized. The flow to each layer of the headbox was about 33% of the total sheet. The three layers of the finished tissue from top to bottom were labeled as air, core and dry. The air layer is the outer layer that is placed on the TAD fabric, the dry layer is the outer layer that is closest to the surface of the Yankee dryer and the core is the center section of the tissue. The towel was produced with 75% NBSK (Grand Prairie NBSK, purchased from International Paper, 6400 Poplar Ave, Memphis, TN 38197. Tel: 1-901-419-6500) and 25% eucalyptus (Cenibra pulp purchased from Itochu International 1251 Avenue of the Americas, New York, NY 10020, Tel: +1-212-818-8244) in all three layers. High cationic HMW GPAM copolymers (Hercobond™ Plus 555 dry-strength additive, purchased from Solenis 2475 Pinnacle Drive, Wilmington, DE 19803 USA Tel: +1-866-337-1533) at 11.0 kg/metric ton (dry basis) and 5.0 kg/metric ton (dry basis) of a HMW APAM (Hercobond™ 2800 dry-strength additive, purchased from Solenis) were added to each of the three layers to generate wet strength. Additionally, 1.5 kg/metric ton (dry basis) of a polyvinylamine retention aid (Hercobond™ 6950 dry-strength additive from Solenis) was utilized. The NBSK was refined separately before blending into the layers using 60 kwh/metric ton on one conical refiner. The Yankee and TAD section speed was 1200 m/min running 6% slower than the forming section. The Reel section was additionally running 3% faster than the Yankee. The towel was then plied together using the DEKO method described herein using a steel emboss roll with the pattern shown in FIG. 1 and 7% polyvinyl alcohol based adhesive heated to 120 deg F. A rolled 2-ply product was produced with 162 sheets and a roll diameter of 148 mm, with each sheet having a length of 6.0 inches and a width of 11 inches. The 2-ply tissue product had the following product attributes: Basis Weight 41.6 g/m$^2$, Caliper 0.728 mm, MD tensile of 538 N/m, CD tensile of 490 N/m, a ball burst of 1108 grams force, an MD stretch of 20.4%, a CD stretch of 12.7%, a CD wet tensile of 125.2 N/m, an absorbency of 12.58 g/g, a dip and dunk absorbency of 522 gsm, and a TSA hand-feel softness of 42.8, with a TS7 of 25.2, and a TS750 of 54.0, a wet scrub of 114 revolutions, a wet caliper of 533 microns/2 ply, and a wet ball burst of 405 gf. No PAE resin was used in this example.

Example 4

Paper towel was made on a wet-laid asset with a three layer headbox using the through air dried method. A TAD fabric design named AJ469 supplied by Asten Johnson (4399 Corporate Road, Charleston, SC 29405 USA Tel: +1.843.747.7800) was utilized. The flow to each layer of the headbox was about 33% of the total sheet. The three layers of the finished tissue from top to bottom were labeled as air, core and dry. The air layer is the outer layer that is placed on the TAD fabric, the dry layer is the outer layer that is closest to the surface of the Yankee dryer and the core is the center section of the tissue. The towel was produced with 75% NBSK (Grand Prairie NBSK, purchased from International Paper, 6400 Poplar Ave, Memphis, TN 38197. Tel: 1-901-419-6500) and 25% eucalyptus (Cenibra pulp purchased from Itochu International 1251 Avenue of the Americas, New York, NY 10020, Tel: +1-212-818-8244) in all three layers. High cationic HMW GPAM copolymers (Hercobond™ Plus 555 dry-strength additive, purchased from Solenis 2475 Pinnacle Drive, Wilmington, DE 19803 USA Tel: +1-866-337-1533) at 4.5 kg/metric ton (dry basis), polyamine polyamide-epichlorohydrin resin (Kymene™ 1500LV wet-strength resin, purchased from Solenis 2475 Pinnacle Drive, Wilmington, DE 19803 USA Tel: +1-866-337-1533) at 2.5 kg/metric ton (dry basis) and 5.0 kg/metric ton (dry basis) of a high molecular weight Anionic Polyacrylamide (Hercobond™ 2800 dry-strength additive, purchased from Solenis) were added to each of the three layers to generate wet strength. Additionally, 1.5 kg/metric ton (dry basis) of a polyvinylamine retention aid (Hercobond™ 6950 dry-strength additive from Solenis) was utilized. The NBSK was refined separately before blending into the layers using 60 kwh/metric ton on one conical refiner. The Yankee and TAD section speed was 1200 m/min running 6% slower than the forming section. The Reel section was additionally running 3% faster than the Yankee. The towel was then plied together using the DEKO method described herein using a steel emboss roll with the pattern shown in FIG. 1 and 7% polyvinyl alcohol based adhesive heated to 120 deg F. A rolled 2-ply product was produced with 152 sheets and a roll diameter of 148 mm, with each sheet having a length of 6.0 inches and a width of 11 inches. The 2-ply tissue product had the following product attributes: Basis Weight 40.6 g/m$^2$, Caliper 0.754 mm, MD tensile of 417 N/m, CD tensile of 412 N/m, a ball burst of 1058 grams force, an MD stretch of 18.5%, a CD stretch of 11.9%, a CD wet tensile of 112.2 N/m, an absorbency of 14.33 g/g, a dip and dunk absorbency of 560 gsm, and a TSA hand-feel softness of 45.4, with a TS7 of 23.7, and a TS750 of 45.8, a wet scrub of 95 revolutions, a wet caliper of 534 microns/2 ply, and a wet ball burst of 334 gf. The measured concentration of CPD in the product was 500 parts per billion while the measured DCP concentration was 53 parts per billion, Test Method: Paragraph 64 of the LFGB, Method B 80.56-2-2002-09 by means of GCMS. The water extract was prepared according to DIN EN 645: 1994-01, 10 g of paper per 250 ml cold water. ISEGA (Zeppelinstraße 3, 63741 Aschaffenburg, Germany) was the vendor who conducted the testing. PAE was measured at 0.054%. Hot water extraction of the complex from two layers of the product yielded 0.036 g with an extract percentage of 0.55%. Limited machine white water recycled and no furnish recycled or broke was used.

Comparative Example 2

Paper towel was made on a wet-laid asset with a three layer headbox using the through air dried method. A TAD fabric design named AJ469 supplied by Asten Johnson (4399 Corporate Road, Charleston, SC 29405 USA Tel: +1.843.747.7800) was utilized. The flow to each layer of the headbox was about 33% of the total sheet. The three layers of the finished tissue from top to bottom were labeled as air, core and dry. The air layer is the outer layer that is placed on the TAD fabric, the dry layer is the outer layer that is closest to the surface of the Yankee dryer and the core is the center section of the tissue. The towel was produced with 75% NBSK (Grand Prairie NBSK, purchased from International Paper, 6400 Poplar Ave, Memphis, TN 38197. Tel: 1-901-419-6500) and 25% eucalyptus (Cenibra pulp purchased from Itochu International 1251 Avenue of the Americas, New York, NY 10020, Tel: +1-212-818-8244) in all three layers. Polyamine polyamide-epichlorohydrin resin (Kymene™ 1500LV wet-strength resin, purchased from Solenis 2475 Pinnacle Drive, Wilmington, DE 19803 USA Tel: +1-866-337-1533) at 9.0 kg/metric ton (dry basis) and 5.0 kg/metric ton (dry basis) of a HMW APAM (Hercobond™ 2800 dry-strength additive, purchased from Solenis) were added to each of the three layers to generate wet strength. Additionally, 1.5 kg/metric ton (dry basis) of a polyvinylamine retention aid (Hercobond™ 6950 dry-strength additive from Solenis) was utilized. The NBSK was refined separately before blending into the layers using 60 kwh/metric ton on one conical refiner. The Yankee and TAD section speed was 1200 m/min running 6% slower than the forming section. The Reel section was additionally running 3% faster than the Yankee. The towel was then plied together using the DEKO method described herein using a steel emboss roll with the pattern shown in FIG. 1 and 7% polyvinyl alcohol-based adhesive heated to 120 deg F. A rolled 2-ply product was produced with 146 sheets and a roll diameter of 148 mm, with each sheet having a length of 6.0 inches and a width of 11 inches. The 2-ply tissue product had the following product attributes: Basis Weight 41.4 g/m$^2$, Caliper 0.790 mm, MD tensile of 436 N/m, CD tensile of 360 N/m, a ball burst of 1031 grams force, an MD stretch of 18.0%, a CD stretch of 11.2%, a CD wet tensile of 105.2 N/m, an absorbency of 14.1 g/g, a dip and dunk absorbency of 532 gsm, and a TSA hand-feel softness of 49.0, with a TS7 of 22.8, and a TS750 of 42.0, a wet scrub of 95 revolutions, a wet burst of 310.7 grams force, and a wet caliper of 600 microns/2 ply. The measured concentration of CPD in the product was 2375 parts per billion while the measured DCP concentration was 190 parts per billion, Test Method: Paragraph 64 of the LFGB, Method B 80.56-2-2002-09 by means of GCMS. The water extract was prepared according to DIN EN 645: 1994-01, 10 g of paper per 250 ml cold water. ISEGA (Zeppelinstraße 3, 63741 Aschaffenburg, Germany) was the vendor that conducted the testing. Limited machine white water recycled and no furnish recycled or broke was used.

Comparative Example 3

Paper towel was made on a wet-laid asset with a three layer headbox using the through air dried method. A TAD fabric developmental design was produced using the methods of U.S. Pat. No. 10,815,620, the contents of which are hereby incorporated by reference in their entirety. The TAD fabric was a laminated composite fabric with a web contacting layer made of extruded thermoplastic polyurethane netting with 30 elements per inch in the machine direction by 5 elements per inch in the cross direction. The machine direction elements have a width of approximately 0.26 mm and cross machine direction elements with a width of 0.6 mm. The distance between MD elements was approximately 0.60 mm and the distance between the CD elements was 5.5 mm. The overall pocket depth was equal to the thickness of the netting which was equal to 0.4 mm. The depth from the top surface of the netting to the top surface of the CD element was 0.25 mm. The supporting layer had a 0.27×0.22 mm cross-section rectangular MD yarn (or filament) at 56 yarns/inch, and a 0.35 mm thickness CD yarn at 41 yarns/inch. The weave pattern of the base layer was a 5-shed, 1 MD yarn over 4 CD yarns, then under 1 CD yarn, then repeated. The material of the base fabric yarns was 100% PET. The composite fabric had an air permeability of approximately 450 cfm. The flow to each layer of the headbox was about 33% of the total sheet. The three layers of the finished towel from top to bottom were labeled as air, core and dry. The air layer is the outer layer that is placed on the TAD fabric, the dry layer is the outer layer that is closest to the surface of the Yankee dryer and the core is the center section of the tissue. The towel was produced with 50% NBSK (Grand Prairie NBSK, purchased from International Paper, 6400 Poplar Ave, Memphis, TN 38197. Tel: 1-901-419-6500) and 50% eucalyptus (Cenibra pulp purchased from Itochu International 1251 Avenue of the Americas, New York, NY 10020, Tel: +1-212-818-8244) in all three layers. "G3" Polyamine polyamide-epichlorohydrin resin (Kymene™ GHP20 wet-strength resin, purchased from Solenis 2475 Pinnacle Drive, Wilmington, DE 19803 USA Tel: +1-866-337-1533) at 9.0 kg/metric ton (dry basis) and 5.0 kg/metric ton (dry basis) of a HMW APAM (Hercobond™ 2800 dry-strength additive, purchased from Solenis) were added to each of the three layers to generate wet strength. Additionally, 1.5 kg/metric ton (dry basis) of a polyvinylamine retention aid (Hercobond™ 6950 dry-strength additive from Solenis) was utilized. The NBSK was refined separately before blending into the layers using 71 kwh/metric ton on one conical refiner. The BEK was refined separately before blending into the layers using 20 kwh/metric ton on one conical refiner. The Yankee and TAD section speed was 1000 m/min running 3% slower than the forming section. The Reel section was additionally running 10% slower than the Yankee. The towel was then plied together using the DEKO method described herein using a steel emboss roll with the pattern shown in FIG. 1 and 7% polyvinyl alcohol-based adhesive heated to 120 deg F. A rolled 2-ply product was produced with 228 sheets and a roll diameter of 148 mm, with each sheet having a length of 6.0 inches and a width of 11 inches. The 2-ply tissue product had the following product attributes: Basis Weight 42 g/m2, Caliper 0.508 mm, MD tensile of 407 N/m, CD tensile of 486 N/m, a ball burst of 944 grams force, an MD stretch of 20.2%, a CD stretch of 11.0%, a CD wet tensile of 129.9 N/m, an absorbency of 11.49 g/g, a dip and dunk absorbency of 485 gsm, and a TSA hand-feel softness of 51.5, with a TS7 of 21.7 and a TS750 of 38.7, a wet scrub of 49 revolutions, a wet burst of 336.6 grams force, and a wet caliper of 455.7 microns/2 ply. The measured concentration of CPD in the product was 148 parts per billion while the measured DCP concentration was less than 50 parts per billion, Test Method: Paragraph 64 of the LFGB, Method B 80.56-2-2002-09 by means of GCMS. The water extract was prepared according to DIN EN 645: 1994-01, 10 g of paper per 250 ml cold water. ISEGA (Zeppelinstraße 3, 63741 Aschaffenburg, Germany) was the vendor that conducted the testing. The PAE percentage was 0.12 by weight. Limited machine white water recycled and no furnish recycled or broke was used.

Comparative Example 5

Paper towel was made on a wet-laid asset with a three-layer headbox using the through air dried method. A TAD fabric design named AJ469 with a round weft (0.65 mm) supplied by Asten Johnson (4399 Corporate Road, Charleston, SC 29405 USA Tel: +1.843.747.7800) was utilized. The flow to each layer of the headbox was about 33% of the total sheet. The three layers of the finished tissue from top to bottom were labeled as air, core and dry. The air layer is the outer layer that is placed on the TAD fabric, the dry layer is the outer layer that is closest to the surface of the Yankee dryer and the core is the center section of the tissue. The towel was produced with 70% NBSK (Grand Prairie NBSK, purchased from International Paper, 6400 Poplar Ave, Memphis, TN 38197. Tel: 1-901-419-6500) and 30% eucalyptus (Cenibra pulp purchased from Itochu International 1251 Avenue of the Americas, New York, NY 10020, Tel: +1-212-818-8244) in all three layers. Fennorez 3000 a GPAM copolymer from Kemira (Energiakatu 4 P.O. Box 330 00101 Helsinki, Finland Tel. +358 10 8611 Fax. +358 10 862 1119.) at 2.0 kg/metric ton (dry basis) and 2.0 kg/metric ton (dry basis) of an APAM (Fennobond 85, purchased from Kemira) were added to each of the three layers to generate wet strength. For this Example, exemplary polymeric aldehyde-functionalized polymers can be a glyoxylated polyacrylamide, such as a cationic glyoxylated polyacrylamide or APAM as described in U.S. Pat. Nos. 3,556,932, 3,556,933, 4,605,702, 7,828,934, and U.S. Patent Application 2008/0308242, each of which is incorporated herein by reference. Such compounds include FENNOBOND™ brand polymers from Kemira Chemicals of Helsinki, Finland. The NBSK was refined separately before blending into the layers using 60 kwh/metric ton on one conical refiner. The Yankee and TAD section speed was 1350 m/min running 12% slower than the forming section. The Reel section was additionally at the same speed as the Yankee. The towel was then plied together using the DEKO method described herein using a steel emboss roll with the pattern shown in FIG. 1 and 7% polyvinyl alcohol-based adhesive heated to 120 deg F. A rolled 2-ply product was produced with 148 sheets and a roll diameter of 148 mm, with each sheet having a length of 6.0 inches and a width of 11 inches. The 2-ply tissue product had the following product attributes: Basis Weight 38.4 g/m2, Caliper 0.778 mm, MD tensile of 280 N/m, CD tensile of 302 N/m, a ball burst of 708 grams force, an MD stretch of 14.6%, a CD stretch of 8.6%, a CD wet tensile of 57.3 N/m, an absorbency of 14.15 g/g, a dip and dunk absorbency of 561 gsm, and a TSA hand-feel softness of 46.8, with a TS7 of 22.5, and a TS750 of 52.4, and D value of 2.4, a wet scrub of 35 revolutions, a wet caliper of 542 microns/2ply, and a wet ball burst of 140 gf. No PAE resin was added.

Example 5

Paper towel was made on a wet-laid asset with a three layer headbox using the through air dried method. A TAD fabric design named AJ469 with a round weft (0.65 mm) was supplied by Asten Johnson (4399 Corporate Road, Charleston, SC 29405 USA Tel: +1.843.747.7800) was utilized. The flow to each layer of the headbox was about 33% of the total sheet. The three layers of the finished tissue from top to bottom were labeled as air, core and dry. The air layer is the outer layer that is placed on the TAD fabric, the dry layer is the outer layer that is closest to the surface of the Yankee dryer and the core is the center section of the tissue. The towel was produced with 70% NBSK (Grand Prairie NBSK, purchased from International Paper, 6400 Poplar Ave, Memphis, TN 38197. Tel: 1-901-419-6500) and 30% eucalyptus (Cenibra pulp purchased from Itochu International 1251 Avenue of the Americas, New York, NY 10020, Tel: +1-212-818-8244) in all three layers. High cationic HMW GPAM copolymers (Hercobond™ Plus 555 dry-strength additive, purchased from Solenis 2475 Pinnacle Drive, Wilmington, DE 19803 USA Tel: +1-866-337-1533) at 6.3 kg/metric ton (dry basis) and 2.1 kg/metric ton (dry basis) of a HMW APAM (Hercobond™ 2800 dry-strength additive, purchased from Solenis) were added to each of the three layers to generate wet strength. Additionally, 0.3 kg/metric ton (dry basis) of a polyvinylamine retention aid (Hercobond™ 6950 dry-strength additive from Solenis) was utilized. The NBSK was refined separately before blending into the layers using 60 kwh/metric ton on one conical refiner. The Yankee and TAD section speed was 1350 m/min running 12% slower than the forming section. The Reel section was additionally running 2% slower than the Yankee. The towel was then plied together using the DEKO method described herein using a steel emboss roll with the pattern shown in FIG. 1 and 7% polyvinyl alcohol-based adhesive heated to 120 deg F. A rolled 2-ply product was produced with 143 sheets and a roll diameter of 148 mm, with each sheet having a length of 6.0 inches and a width of 11 inches.

The 2-ply tissue product had the following product attributes: Basis Weight 40.8 g/m2, Caliper 0.840 mm, MD tensile of 398 N/m, CD tensile of 445 N/m, a ball burst of 1042 grams force, an MD stretch of 18.0%, a CD stretch of 9.3%, a CD wet tensile of 105 N/m, an absorbency of 15.16 g/g, a dip and dunk absorbency of 572 gsm, and a TSA hand-feel softness of 41.9, with a TS7 of 27.3, and a TS750 of 54.8, and a D value of 2.2, a wet scrub of 85 revolutions, a wet caliper of 594 microns/2 ply, and a wet ball burst of 266 gf. The measured concentration of CPD in the product was less than 50 parts per billion while the measured DCP concentration was less than 50 parts per billion, Test Method: Paragraph 64 of the LFGB, Method B 80.56-2-2002-09 by means of GCMS. The water extract was prepared according to DIN EN 645: 1994-01, 10 g of paper per 250 ml cold water. ISEGA (Zeppelinstraße 3, 63741 Aschaffenburg, Germany) was the vendor that conducted the testing. No machine white water or furnish were reused or recycled. PAE content was less than 0.02%. No adipic acid PAE was detected in this sample. Only glutaric acid PAE was detected, which is known to be added to the Yankee coating. Hot water extraction from all three layers of the product yielded 0.038 grams and 0.57% complex extracted.

Example 6

Paper towel was made on a wet-laid asset with a three layer headbox using the through air dried method. A laminated composite fabric with a polyurethane netting with an MD of 16 strands per inch by 14 strands per inch CD as described in U.S. Pat. No. 10,815,620 was utilized. The flow to each layer of the headbox was about 33% of the total sheet. The three layers of the finished tissue from top to bottom were labeled as air, core and dry. The air layer is the outer layer that is placed on the TAD fabric, the dry layer is the outer layer that is closest to the surface of the Yankee dryer and the core is the center section of the tissue. The towel was produced with 70% NBSK (Grand Prairie NBSK, purchased from International Paper, 6400 Poplar Ave, Memphis, TN 38197. Tel: 1-901-419-6500) and 30% eucalyptus (Cenibra pulp purchased from Itochu International 1251 Avenue of the Americas, New York, NY 10020, Tel: +1-212-818-8244) in all three layers. High cationic HMW GPAM copolymers (Hercobond™ Plus 555 dry-strength additive, purchased from Solenis 2475 Pinnacle Drive, Wilmington, DE 19803 USA Tel: +1-866-337-1533) at 9.0 kg/metric ton (dry basis) and 5.0 kg/metric ton (dry basis) of a HMW APAM (Hercobond™ 2800 dry-strength additive, purchased from Solenis) were added to each of the three layers to generate wet strength. Additionally, 1.5 kg/metric ton (dry basis) of a polyvinylamine retention aid (Hercobond™ 6950 dry-strength additive from Solenis) was utilized. The NBSK was refined separately before blending into the layers using 100 kwh/metric ton on one conical refiner. The Yankee and TAD section speed was 1000 m/min running 6% slower than the forming section. The Reel section was additionally running 14% slower than the Yankee. The towel was then plied together using the DEKO method described herein using a steel emboss roll with the pattern shown in FIG. 1 and 7% polyvinyl alcohol based adhesive heated to 120 deg F. A rolled 2-ply product was produced with 134 sheets and a roll diameter of 148 mm, with each sheet having a length of 6.0 inches and a width of 11 inches. The 2-ply tissue product had the following product attributes: Basis Weight 43.2 g/m2, Caliper 0.908 mm, MD tensile of 407 N/m, CD tensile of 441 N/m, a ball burst of 1149 grams force, an MD stretch of 25.4%, a CD stretch of 13.1%, a CD wet tensile of 125.6 N/m, an absorbency of 17.60 g/g, a dip and dunk absorbency of 669 gsm, and a TSA hand-feel softness of 38.3, with a TS7 of 33.9, and a TS750 of 33.2, and a D value of 2.2, a wet scrub of 110 revolutions, a wet caliper of 610 microns/2 ply. The wet ball burst could not be measured. The measured concentration of CPD in the product was less than 50 parts per billion while the measured DCP concentration was less than 50 parts per billion, Test Method: Paragraph 64 of the LFGB, Method B 80.56-2-2002-09 by means of GCMS. The water extract was prepared according to DIN EN 645: 1994-01, 10 g of paper per 250 ml cold water. ISEGA (Zeppelinstraße 3, 63741 Aschaffenburg, Germany) was the vendor that conducted the testing. Limited machine white water recycled and no furnish recycled or broke was used.

Example 7

Paper towel was made on a wet-laid asset with a three-layer headbox using the through air dried method. A TAD fabric design named AJ469 supplied by Asten Johnson (4399 Corporate Road, Charleston, SC 29405 USA Tel: +1.843.747.7800) was utilized. The flow to each layer of the headbox was about 33% of the total sheet. The three layers of the finished tissue from top to bottom were labeled as air, core and dry. The air layer is the outer layer that is placed on the TAD fabric, the dry layer is the outer layer that is closest to the surface of the Yankee dryer and the core is the center section of the tissue. The towel was produced with 65% NBSK (Grand Prairie NBSK was 25% of the NBSK blend while Domtar Dryden was 75% of the NBSK blend) and 35% eucalyptus (Cenibra pulp was 40% of the EUC blend while CMPC eucalyptus was 60% by weight of the EUC blend)) in all three layers. High cationic HMW GPAM copolymers (Hercobond™ Plus 555 dry-strength additive, purchased from Solenis 2475 Pinnacle Drive, Wilmington, DE 19803 USA Tel: +1-866-337-1533) at 4.3 kg/metric ton (dry basis) and 2.35 kg/metric ton (dry basis) of a HMW APAM (Hercobond™ 1044 dry-strength additive, purchased from Solenis) were added to each of the three layers to generate wet strength. Additionally, 0.4 kg/metric ton (dry basis) of a polyvinylamine retention aid (Hercobond™ 6350 dry-strength additive from Solenis) was utilized and 2.2 kg/ton of Kymene was used. The NBSK was refined separately before blending into the layers using 62 kwh/metric ton with two disk refiner. The core layer had ~32% broke mass added. The white water was reused and all trim on machine was used during the trial. The Yankee and TAD section speed was 1425 m/min running 10% slower than the forming section. The Reel section was additionally running 1.5% slower than the Yankee. The towel was then plied together using the DEKO method described herein using a steel emboss roll with the pattern shown in FIG. 1 and 7% polyvinyl alcohol based adhesive heated to 120 deg F. A rolled 2-ply product was produced with 150 sheets and a roll diameter of 148 mm, with each sheet having a length of 6.0 inches and a width of 11 inches. The 2-ply tissue product had the following product attributes: Basis Weight 40.2 g/m$^2$, Caliper 0.794 mm, MD tensile of 395 N/m, CD tensile of 364 N/m, a ball burst of 962 grams force, an MD stretch of 16.8%, a CD stretch of 9.6%, a CD wet tensile of 111 N/m, an absorbency of 13.15 g/g, a dip and dunk absorbency of 561 gsm, and a TSA hand-feel softness of 54, with a TS7 of 19, and a TS750 of 47.5, a wet scrub of 71 revolutions, a wet caliper of 569 microns/2 ply, and a wet ball burst of 288 gf.

DCP of 30 ppb and CPD of 275 ppb were detected in the converted sample. PAE level of 0.094% by weight was also detected.

Comparitive Example 8

Paper towel was made on a wet-laid asset with a three layer headbox using the through air dried method. A TAD fabric design named AJ469 supplied by Asten Johnson (4399 Corporate Road, Charleston, SC 29405 USA Tel: +1.843.747.7800) was utilized. The fabric had flat warp yarns of 0.354 mm by 0.4 mm and round weft yarns of 0.65 mm diameter. The flow to each layer of the headbox was about 33% of the total sheet. The three layers of the finished tissue from top to bottom were labeled as air, core and dry. The air layer is the outer layer that is placed on the TAD fabric, the dry layer is the outer layer that is closest to the surface of the Yankee dryer and the core is the center section of the tissue. The towel was produced with 60% NBSK (Grand Prarie NBSK, purchased from International Paper, 6400 poplar Ave, Memphis, TN 38197) and 40% eucalyptus (Cenibra pulp purchased from Itochu International 1251 Avenue of the Americas, New York, NY 10020, Tel: +1-212-818-8244) in all three layers. A wet strength resin (Kymene 1500, purchased from Solenis 2475 Pinnacle Drive, Wilmington, DE 19803 USA Tel: +1-866-337-1533) at 6.3 kg/metric ton (dry basis) (pulp mixture become cationic at this time) and 2.1 kg/metric ton (dry basis) of a HMW APAM (Hercobond™ 1044 dry-strength additive, purchased from Solenis. This APAM is a lower charge version of 2800) and 1.5 kg/metric ton (dry basis) of polyvinyl amine (Hercobond 6950, purchased from Solenis) were added to each of the three layers to generate wet strength. Headbox charge was slightly anionic. The NBSK was refined separately before blending into the layers using 90 kwh/metric ton on one conical refiner. The Yankee and TAD section speed was 1350 m/min running 6% slower than the forming section. The Reel section was additionally running 3% faster than the Yankee.

Two plies of the paper web were placed together with the air side of both webs facing the interior of the 2-ply sheet and tested according to the test methods specified. The 2-ply towel product had the following product attributes: Basis Weight 43.9 g/m$^2$, MD tensile of 370 N/m, CD tensile of 361 N/m, and a CD wet tensile of 107 N/m.

Example 8

Paper towel was made on a wet-laid asset with a three layer headbox using the through air dried method. A TAD fabric design named AJ469 supplied by Asten Johnson (4399 Corporate Road, Charleston, SC 29405 USA Tel: +1.843.747.7800) was utilized. The fabric had flat warp yarns of 0.354 mm by 0.4 mm and round weft yarns of 0.65 mm diameter. The flow to each layer of the headbox was about 33% of the total sheet. The three layers of the finished tissue from top to bottom were labeled as air, core and dry. The air layer is the outer layer that is placed on the TAD fabric, the dry layer is the outer layer that is closest to the surface of the Yankee dryer and the core is the center section of the tissue. The towel was produced with 60% NBSK (Grand Prarie NBSK, purchased from International Paper, 6400 poplar Ave, Memphis, TN 38197) and 40% eucalyptus (Cenibra pulp purchased from Itochu International 1251 Avenue of the Americas, New York, NY 10020, Tel: +1-212-818-8244) in all three layers. High cationic HMW GPAM copolymers (Hercobond™ Plus 555 dry-strength additive, purchased from Solenis 2475 Pinnacle Drive, Wilmington, DE 19803 USA Tel: +1-866-337-1533) at 6.3 kg/metric ton (dry basis) (pulp mixture remained anionic) and 1.0 kg/metric ton (dry basis) of a HMW APAM (Hercobond™ 1044 dry-strength additive, purchased from Solenis) 1.5 kg/metric ton (dry basis) of Hercobond 7530 from Solenis, and 1.5 kg/metric ton (dry basis) of polyvinyl amine (Hercobond 6950, purchased from Solenis) were added to each of the three layers to generate wet strength. Headbox charge was anionic. The NBSK was refined separately before blending into the layers using 90 kwh/metric ton on one conical refiner. The Yankee and TAD section speed was 1350 m/min running 6% slower than the forming section. The Reel section was additionally running 3% faster than the Yankee.

Two plies of the paper web were placed together with the air side of both webs facing the interior of the 2-ply sheet and tested according to the test methods specified. The 2-ply towel product had the following product attributes: Basis Weight 43.4 g/m$^2$, MD tensile of 543 N/m, CD tensile of 501 N/m, and a CD wet tensile of 110 N/m. No PAE resin was added to produce this sample.

* * *

The pulp fiber chemical composition is important to list for the examples above. Without being bound by theory, while the exact mechanism by which wet strength is obtained by exemplary embodiments of this invention is difficult to define, the retention of the GPAM/APAM complex is important, and the bonding between the complex and pulp fibers (ionic or covalent) is also important. The Gamma celllulose and pentosan content do impact the wet strength obtained and retention methods described herein. Gamma cellulose was measured by T 203 and Pentosans were measured by T 223. Data on the pulps used in the examples above are: Cenibra EUC—Gamma 1.1%, Pentasans 16.3%; Peace River NBSK—Gamma 7.2%, Pentosans 8.7%; Grande Praire NBSK—Gamma 12.0%, Pentosans 8.6%; Dryden NBSK—Gamma 7%, Pentosans 9.2%. Concentration of Gamma or Pentosans can be calculated by using blend percentages of each pulp times the concentrations listed above. While attempts were made to add isolated hemicellulose or hemicellulose biopolymers complexes to the pulp blend, these biopolymers were not effectively retained in the wet-end systems used. When using pulp fibers with high Gamma or Pentosans, higher wet strength values could be obtained.

As is evident from the above Examples and Comparative Examples, methods in accordance with exemplary embodiments of the present invention achieve a roll retail towel with very low DCP and MCPD and ultra-premium towel properties (bulk, absorbency, MD/CD dry strength and CD wet strength) with very low doses of PAE. By way of background, G2 or G3 PAE, which is distilled PAE (i.e., chlorine material is removed before use in the mill) may be used to obtain some level of wet strength. However, the distilled PAE produces chlorine compound and has lower reactivity and lower wet strength properties per molecule. Further, more distilled PAE is needed to obtain high levels of wet strength, which is detrimental to absorbency and the environment and expensive. Overall, the use of G2/G3 PAE results in a towel product with low strength, low absorbency, and low bulk at a higher cost.

As shown in Comparative Example 5, desirable properties for a towel product may not be achieved using an GPAM/APAM complex if the molecular weight of the GPAM/APAM complex is too low or radius of gyration (ROG)

(explained further below) of the complex is not optimal. In contrast, the use of a very large molecular weight complex in accordance with exemplary embodiments of the present invention form a "net" around the pulp fiber web, thereby holding the web together. Thus, it is preferable to produce the GPAM on the mill site, at 2% solids. In contrast, most GPAM is at >5% solids or close to 10% solids.

Without being bound by theory, an important aspect of the present invention involves the use of a high MW GPAM/APAM complex that remains anionic, as opposed to the conventional technique involving the use of a cationic complex. It is believed that the use of a GPAM/APAM complex that remains anionic creates more ionic or covalent bonds between the complex and the pulp fibers. This is counter to the conventional belief that a cationic complex is required to bond with an anionic fiber (e.g., all virgin pulp fibers). Again, without being bound by theory, it is believed that charge is not the governing factor and the amount of connections in the net is equally or more important. A cationic GPAM/APAM complex indicates that the GPAM charge over-takes the APAM. The APAM polymer is consumed and may not expand to its largest size. Using an anionic GPAM/APAM complex results in a larger anionic size, which can be expressed as the ROG of the polymer. A larger ROG will create a larger net with the same number of molecules.

The large anionic GPAM/APAM complex may not be retained at high enough levels without the PVAM retention aid. The PVAM is very highly cationic. This high charge forces the GPAM/APAM complex to bond with the pulp fibers which have an evenly spaced negative charge.

While in the foregoing specification a detailed description of specific embodiments of the invention were set forth, it will be understood that many of the details herein given may be varied considerably by those skilled in the art without departing from the spirit and scope of the invention.

The invention claimed is:

1. A retail roll through air dried towel product comprising: at least one cellulose sheet or web having a cross direction wet strength of 80 to 200 N/m and a caliper of 600 to 1500 microns, wherein the retail roll towel product contains 0 to 0.09% by weight polyaminoamide-epi-halohydrin and has a (dip and dunk) absorbency of from 500 to 700 gsm.

2. The retail roll product of claim 1, further comprising microfibrillated cellulose.

3. The retail roll product of claim 2, wherein the product is free from synthetic fibers.

4. The retail roll product of claim 1, wherein the product is free from latex.

5. The retail roll product of claim 1, wherein the product is wet laid.

6. The retail roll product of claim 1, wherein the product is creped.

7. The retail roll product of claim 1, wherein the product is devoid of dye or colored fibers.

8. The retail roll product of claim 1, wherein the product is devoid of any additive made from epichlorohydrin.

* * * * *